US008213848B2

(12) United States Patent
Ishikake et al.

(10) Patent No.: US 8,213,848 B2
(45) Date of Patent: Jul. 3, 2012

(54) IMAGE FORMING APPARATUS INCLUDING A FIXING DEVICE CONFIGURED TO APPLY HEAT AND METHOD THEREOF

(75) Inventors: Satoru Ishikake, Kawasaki (JP); Manabu Mochizuki, Yokohama (JP); Tsuneo Kurotori, Tokyo (JP); Yoshihiro Arai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 494 days.

(21) Appl. No.: 12/385,176

(22) Filed: Apr. 1, 2009

(65) Prior Publication Data

US 2009/0245896 A1 Oct. 1, 2009

(30) Foreign Application Priority Data

Apr. 1, 2008 (JP) ..... 2008-094993

(51) Int. Cl.
*G03G 15/20* (2006.01)

(52) U.S. Cl. ..... 399/328

(58) Field of Classification Search ..... 399/328, 399/320, 331, 339
See application file for complete search history.

(56) References Cited

U.S. PATENT DOCUMENTS

| | | | | |
|---|---|---|---|---|
| 4,985,733 | A | 1/1991 | Kurotori et al. | |
| 4,987,457 | A | 1/1991 | Mochizuki et al. | |
| 5,099,289 | A | 3/1992 | Kurotori et al. | |
| 5,155,534 | A | 10/1992 | Kurotori et al. | |
| 5,402,220 | A | 3/1995 | Tanaka et al. | |
| 5,459,561 | A | 10/1995 | Ingram | |
| 5,809,388 | A | 9/1998 | Inada et al. | |
| 5,983,048 | A * | 11/1999 | Moser | 399/67 |
| 6,195,525 | B1 | 2/2001 | Maeyama | |
| 6,381,423 | B1 | 4/2002 | Eom | |
| 6,947,700 | B2 | 9/2005 | Kurotori et al. | |
| 7,046,952 | B2 | 5/2006 | Kurotori et al. | |
| 2004/0081492 | A1 | 4/2004 | Hamada et al. | |
| 2004/0131402 | A1 | 7/2004 | Kurotori et al. | |
| 2005/0254867 | A1 | 11/2005 | Kurotori et al. | |
| 2006/0115762 | A1 | 6/2006 | Katano et al. | |
| 2006/0263712 | A1 | 11/2006 | Katano et al. | |
| 2007/0098469 | A1 | 5/2007 | Yoshino et al. | |
| 2007/0147913 | A1 | 6/2007 | Katano et al. | |
| 2007/0212091 | A1* | 9/2007 | Kinouchi et al. | 399/69 |
| 2007/0242970 | A1* | 10/2007 | Fujino | 399/69 |
| 2007/0243483 | A1 | 10/2007 | Katano et al. | |
| 2008/0063446 | A1 | 3/2008 | Katano et al. | |
| 2008/0213002 | A1 | 9/2008 | Katano et al. | |

(Continued)

FOREIGN PATENT DOCUMENTS

EP 1 158 367 11/2001

(Continued)

OTHER PUBLICATIONS

Computer translation of JP06-118835A; Apr. 1994; Shikato et al.*

(Continued)

*Primary Examiner* — Quana M Grainger
(74) *Attorney, Agent, or Firm* — Harness, Dickey & Pierce, P.L.C.

(57) ABSTRACT

An image forming apparatus includes a first fixing device that applies heat to a non fixed toner image and a second fixing device arranged downstream of the first fixing device, which applies pressure and fixes the non-fixed toner image onto a recording member.

15 Claims, 24 Drawing Sheets

U.S. PATENT DOCUMENTS

2009/0003903 A1 1/2009 Katano et al.

FOREIGN PATENT DOCUMENTS

| | | | |
|---|---|---|---|
| JP | 54-043029 | | 4/1979 |
| JP | 56-125749 | | 10/1981 |
| JP | 56-128979 | | 10/1981 |
| JP | 58-088772 | | 5/1983 |
| JP | 60-069674 | | 4/1985 |
| JP | 4-50982 | | 2/1987 |
| JP | 63-092965 | | 4/1988 |
| JP | 63-57794 | | 11/1988 |
| JP | 03-050586 | | 3/1991 |
| JP | 04-051267 | | 2/1992 |
| JP | 4-31389 | | 5/1992 |
| JP | 4-31393 | | 5/1992 |
| JP | 05-002352 | | 1/1993 |
| JP | 05-158364 | | 6/1993 |
| JP | 58-178385 | | 10/1993 |
| JP | 06118835 | A * | 4/1994 |
| JP | 06-266145 | | 9/1994 |
| JP | 07-028357 | | 1/1995 |
| JP | 07-325493 | | 12/1995 |
| JP | 07-334041 | | 12/1995 |
| JP | 08-262921 | | 10/1996 |
| JP | 09-080939 | | 3/1997 |
| JP | 2000-188177 | | 7/2000 |
| JP | 2000-194215 | | 7/2000 |
| JP | 2001-260599 | | 9/2001 |
| JP | 2001-267641 | | 9/2001 |
| JP | 2003-192467 | | 7/2003 |
| JP | 2003-231397 | | 8/2003 |
| JP | 2005-055516 | | 3/2005 |
| JP | 2005-066862 | | 3/2005 |
| JP | 2006-251257 | | 9/2006 |
| JP | 2006-258831 | | 9/2006 |
| JP | 2007-041025 | | 2/2007 |
| JP | 2007-128109 | | 5/2007 |

OTHER PUBLICATIONS

Partial European Search Report dated Mar. 3, 2010 for corresponding European Application No. 09156968.

U.S. Appl. No. 07/330,699, filed Mar. 30, 1989, Kurotori.

Abstract of JP 61-122665 published on Jun. 10, 1986.

Abstract of JP 61-122666 published on Jun. 10, 1986.

Abstract of JP 62-043562 published on Feb. 25, 1987.

Abstract of JP 57-128374 published on Aug. 9, 1982.

European Search Report dated Sep. 6, 2010 for corresponding European Application No. 09156968.

* cited by examiner

| TEMPERATURE [°C] | NOT MORE THAN 65 | 70 | 75 | 80 |
|---|---|---|---|---|
| EMBODIMENT OF PRESENT INVENTION | × | △ | ○ | ○ |
| HEAT ROLLER FIXING | × | × | × | × |
| PRESSURE FIXING | (×) | — | — | — |

○ : FIXING IS POSSIBLE
△ : PEELING OFF WHEN INTENSELY RUBBED
× : FIXING IS IMPOSSIBLE
(×) : EXECUTION AT AMBIENT TEMPERATURE. FIXING IS IMPOSSIBLE DUE TO NO PRESSURE FIXING USE TONER
— : NOT PRACTICED

IMAGE FORMING APPARATUS INCLUDING A FIXING DEVICE CONFIGURED TO APPLY HEAT AND METHOD THEREOF

CROSS REFERENCE TO RELATED APPLICATION

This application claims priority under 35 USC §119 to Japanese Patent Application No. 2008-094993, filed on Apr. 1, 2008, the entire contents of which are herein incorporated by reference.

BACKGROUND OF THE INVENTION

1. Field of the Invention

The present invention relates to an image forming apparatus, such as a copier, a printer, a plotter, a facsimile, and a complex machine combining these device, etc., having a unique fixing system.

2. Discussion of the Background Art

Conventionally, in an image forming apparatus, such as a copier, a printer, etc., a fixing device is included to fix a toner image transferred onto a recording member. To avoid insufficient fixing, various fixing systems have been developed. In these days, a heat-applying roller that applies heat from a heat-applying source is generally used as a fixing roller, while a pressure-applying roller is provided opposing the fixing roller to form a nip in a heat roller system. Then, an unfixed image is cooperatively fixed onto the recording member by the fixing roller and the pressure-applying roller. A typical example of a conventional fixing device as the heat roller system includes a fixing roller 91 that applies heat to melt toner on the recording member and a pressure applying roller 92 that pressure contacts the fixing roller 91 to pinch the recording member as shown in FIG. 45. The fixing roller 91 is a cylindrical and includes a heat generation member 93 as a heat-applying source around a central axis thereof. The heat generation member 93 includes a halogen lamp or the like and generates heat upon receiving a prescribed power supply. Since the heat generation member 93 is positioned at the central axis of the fixing roller 91, an outer wall of the fixing roller is heated up to 150 to 200 degree centigrade appropriate for fixing. The fixing roller 91 and the pressure applying roller 92 rotate reversely and pinch a recording member having toner attracted thereonto in this situation while contacting each other. Then, the toner on the recording member is fused by the heat and fixed thereon at the nip between the fixing roller 91 and the pressure-applying roller 92.

In a typical prior art of a fixing device having the similar configuration, a recording member carrying a toner image passes through a fixing roller while receiving heat and a pressure applying roller are arranged, so that the toner image can be fixed onto the recording member as shown in the Japanese Patent Application Laid Open No. 2007-128109. However, such a fixing device simply including a heat applying system of the fixing roller consumes significant amount of energy. Because, fixing energy largely relies on heat as a problem. In addition, it especially takes a relatively long time period to increase temperature of the fixing roller suitable for fixing after a power is supplied to an image forming apparatus. Further, the above-mentioned fixing system has some disadvantages when employed in an image forming apparatus capable of feeding sheets at a high line speed. First, since the heat and pressure are simultaneously applied to the toner on the recording member at the nip, a sufficient nipping time period is hardly provided not to cause a fixing error. Thus, when the above-mentioned fixing system is applied to the high-speed machine running at the high-line speed, fixing temperature and pressure of the fixing roller need to be high and large to handle, resulting in significant power consumption.

Further, since the high-speed machine necessarily employs a fixing roller having a large diameter to obtain a nipping time period or the like, calorie increases so that power consumption further increases.

Further, since heat excessive for toner fixing is applied to a non-image area on the recording member, curl or the other undesired phenomena occur on the recording member.

As a fixing apparatus capable of resolving such a problem, the Japanese Patent Application Laid Open No. 58-178385 proposes an induction heat applying fixing apparatus that arranges a core (an open magnetic path iron core) winding a coil around a common axis in a fixing member made of metal. The apparatus flows a high frequency current through the coil and creates a high frequency magnetic field that causes induction heat. Since the fixing member made of metal conductor itself generates heat, it rapidly increases temperature in comparison with a system using a heat generation member, such as a halogen lamp, etc., and has heat efficiency as an advantage. Further, the Japanese Patent Application Laid Open No. Hei 9-80939 proposes a heat applying device included in an image forming apparatus that includes an exciting coil secured to a body, a film having a conductive layer traveling a magnetic field created by the exciting coil, and a heat applying device that pressure contacts an heat application objective against the film, while applying the heat thereto using a eddy current created on the conductive layer of the film to form an image using magnetic toner. The heat-applying device is characterized in that a magnetic field is created downstream in the rotational direction of the film within the section in which the film and the heat-receiving member contact each other to heat the heat-receiving member.

However, according to these configurations, since toner is heated by the magnetic field generation source via the fixing roller or the like serving as a heat-receiving member, heat efficiency is low and consumption of energy increases.

Further, the Japanese Patent Application Laid Open No. 2000-188177 proposes an electromagnetic induction heat applying apparatus having an electromagnetic induction heat applying layer that applies heat to a heat applying objective, in which a magnetic core made of magnetic material are arranged opposing the electromagnetic heat induction layer, and, a movable core capable of changing intensity of alternating magnetic field penetrating the electromagnetic heat induction layer are wound around the magnetic core.

SUMMARY OF THE PRESENT INVENTION

The present invention has been made in view of the above noted and another problems and one object of the present invention is to provide a new and noble image forming apparatus.

Such a new and noble image forming apparatus includes a first fixing device that applies heat to a non fixed toner image and a second fixing device that applies pressure and fixes the non-fixed toner image onto a recording member.

In another embodiment, the fixing device includes a pair of rollers having at least one heat source and applies the heat to the recording member during pinching and conveying the recording member.

In yet another embodiment, the heat source generates radiation heat.

In yet another embodiment, the heat source generates electromagnetic induction heat.

In yet another embodiment, the heat source emits a laser light to the non-fixed toner image.

In yet another embodiment, the second fixing device includes a pair of opposing rollers configured to pinch and pressurize the recording member.

In yet another embodiment, the heat source includes an electromagnetic induction heating device arranged inside a loop of a conveyance belt opposing the conveyance belt.

In yet another embodiment, the electromagnetic induction heating device is divided into plural sections in a direction perpendicular to the traveling direction of the conveyance belt.

In yet another embodiment, the heat source includes a laser light generation device that generates a laser light and a laser light-scanning device that defuses and scans the laser light to the toner image electrostatically attracted to the conveyance belt.

In yet another embodiment, a beam spot diameter-changing device is provided to change a beam spot diameter of the laser beam.

In yet another embodiment, the laser light scanning device is used as an exposure device for forming a latent image on an image bearer.

In yet another embodiment, a process cartridge is provided to install an image bearer and a light path for guiding the laser light to the image bearer.

In yet another embodiment, the process cartridge includes a beam spot diameter changing device arranged on the light path and changes a diameter of the beam of the laser light.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF PREFERRED EMBODIMENTS

Figure 1:
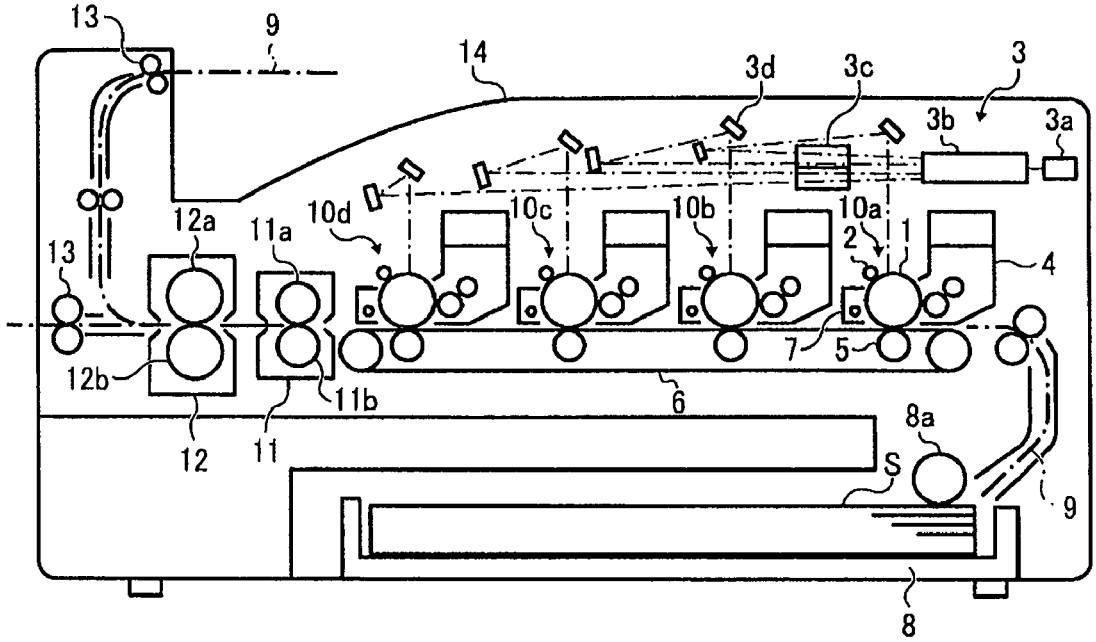
FIG. 1 is a schematic cross sectional view illustrating an exemplary image forming apparatus according to one embodiment of the present invention.

Referring now to the drawings, wherein like reference numerals and marks designate identical or corresponding parts throughout several figures, in particular in FIG. 1, the first embodiment is described. As shown, a versatile image forming apparatus is provided and includes fixing devices arranged in parallel employing heat and pressure applying systems capable of using toner and a recording member for a heat fixing system while suppressing energy consumption. The image forming apparatus can increase a brilliance performance of a toner surface and obtain an almost photographic quality saving the energy. Further, the image forming apparatus is capable of selectively using a pressure applying system in accordance with a necessity of brilliance for a sheet either manually or automatically.

In FIG. 1, four image formation sections 10*a* to 10*d* are arranged along a conveyance belt 6 (hereinafter referred to as a transfer belt 6) that carries and conveys a sheet like recording member S, such as a plain paper, a thick sheet, a post card, an OHP sheet, etc., to a transfer section. Each of the image formation sections 10*a* to 10*d* uses a different color toner for development, but includes the same configuration. Specifically, a drum shaped photoconductive member 1 serving as an image carrier, a charge device 2 that uniformly charges the surface of the photoconductive member 1, and an exposure device 3 that emits a laser light and forms a latent image on the photoconductive member 1 with the charge are included.

Also included are a developing device 4 that visualizes the latent image with the toner on the photoconductive member, a transfer device 5 (e.g. a tar roller 5 or the like) that transfers the toner image visualized on the photoconductive member 1 onto a recording member S conveyed by the transfer belt 6, and a cleaning device 7 that clears the toner remaining on the photoconductive member after the transfer process.

The exposure device includes plural light source devices 3*a* having a semiconductor laser, a coupling lens, an aperture or the like, a deflection device such as a polygon mirror 3*b* that deflects and scans the laser light transmitted from the light source, a scanning use lens 3*c*, and a light path folding back use mirror 3*d* and the like. Thus, the laser lights transmitted from the plural light source devices 3*a* are commonly deflected by the deflector 3*b* and execute the exposure on the photoconductive member 1 of the respective image formation sections 10*a* to 10*d* via the scanning use lens 3*a* and the mirror 3*d*, thereby latent images are formed corresponding to the colors in the image formation sections, respectively. The respective image formation sections 10*a* to 10*d* use color toner of yellow (Y), magenta (M), cyan (C), and black (B) develop the latent images, respective, in this order in a recording member conveyance direction. The thus developed color images are then superimposed sequentially on the recording member S conveyed by the transfer belt 6, thereby a multi or full-color image is formed.

The image forming apparatus also includes a sheet feeding and conveyance device (e.g. a sheet feeding roller 8*a* and a register roller or the like) that conveys the recording members S stacked on the sheet feeding section (a recording member stacking section) 8 one by one in synchronism with a toner image developed by the developing devices in the image formation sections 10*a* to 10*d* toward the transfer belt 6, and fixing devices 11 and 12 that fix the toner image transferred onto the recording member S by the transfer device 5 such as a transfer roller while being conveyed by the transfer belt 6.

In this embodiment, as a fixing device, heat and pressure applying type-fixing devices 11 and 12 are arranged in parallel along the recording member conveyance path 9 in this order. Further, on the downstream side of the recording member conveyance path 9 of the pressure applying device 12, an ejection roller 13 and an ejection tray 14 (or a post processing device) or the like are arranged.

In the image forming apparatus of FIG. 1, the latent images formed on the respective image formation sections 10*a* to 10*d* by the exposure device 3 are developed by the respective color toner, and thereby color toner images are formed. The recording member S launched by the sheet feeding roller 8*a* from the sheet feeding section 8 is carried by the transfer belt 6 and is conveyed in synchronism with the above-mentioned development, and is further subjected to transfer process to receive transfer of the toner image.

The recording member S with a non fixed toner passes through the heat applying device 11 and the pressure applying device 12 consecutively and is ejected onto the sheet ejection tray 14 or the like by the sheet ejection roller 13.

Since toner component to be fixed by the fixing device mainly includes thermoplastic resin and thus is softened when passing through the heat applying device 11 receiving heat. Unevenness of the surface of the toner is smoothed by the surface condition of an upper roller 12*a* receiving pressure when passing through the pressure-applying device 12. Specifically, by finishing the roller 12*a* of the pressure-applying device 12 to have the minimum surface roughness, the toner surface can be more smoothed. Further, toner and a recording member S are more precisely fixed mutually by heat and pressure when passing through the heat and pressure applying devices 11 and 12 sequentially.

Figure 12:
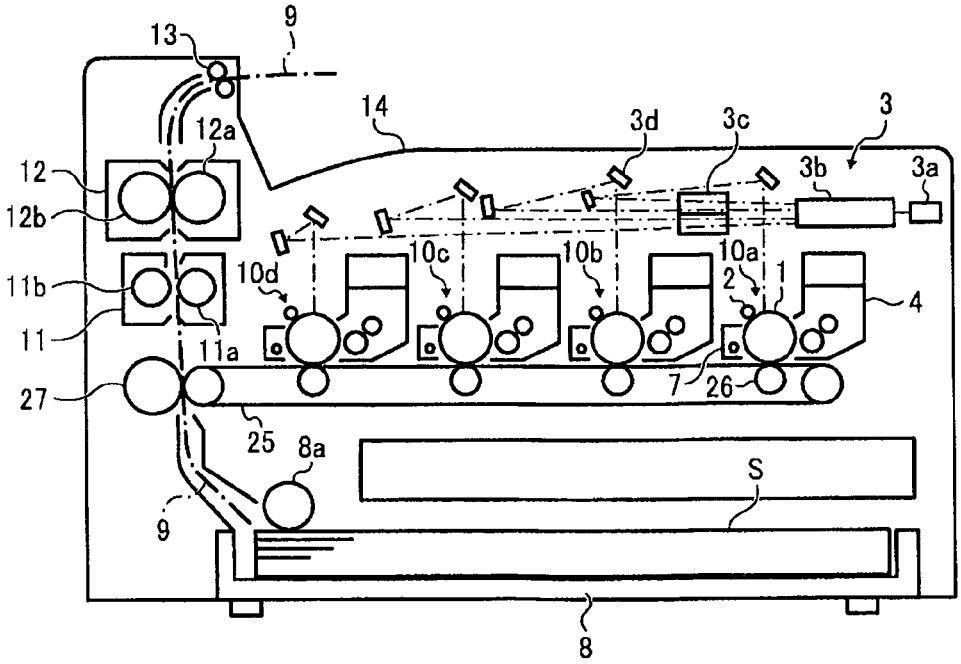
FIG. 12 schematically illustrates another exemplary image forming apparatus of the first embodiment according to the present invention.

As shown FIG. 1, the image forming apparatus employs a direct transfer system in which toner images carried on the respective photoconductive members 1 of the image formation sections 10*a* to 10*d* are transferred onto the recording members S. Beside, as shown in FIG. 12, the image forming apparatus can employ an intermediate transfer system in which toner images carried on the respective photoconductive members 1 of the image formation sections 10*a* to 10*d* are transferred being superimposed on an intermediate transfer member 25 (e.g. an intermediate transfer belt) by a primary transfer device 26 (e.g. a primary transfer roller). The superimposed image on the intermediate transfer member 25 is then transferred onto the recording members S by a secondary transfer device 27. The intermediate transfer member 25 can be either a roller state or a drum state other than the belt state. Plural intermediate transfer members can be arranged between the photoconductive member 1 and the recording member S.

In the image forming apparatus of FIG. 1, the heat applying device 11 serving as a fixing device includes a pair of rollers. One of the pair of rollers has a heating source, such as an electric heater, a halogen heater, a carbon heater, etc. Thus, when the roller directly contacts the recording member S, the heat is conveyed by heat conduction, and accordingly, the toner on the recording member S is softened.

Figure 2:
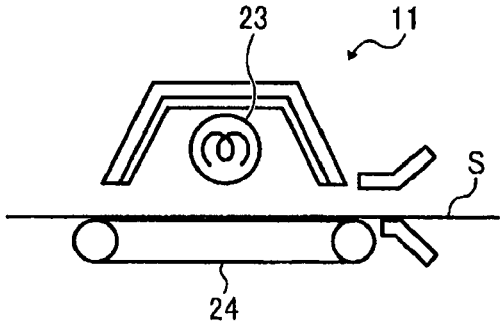
FIG. 2 is a schematic cross sectional view illustrating an exemplary heat-applying device used in a first fixing device included in the image forming apparatus of FIG. 1.

Further, the heat-applying device 11 can employ an oven system that applies radiation heat as shown in FIG. 2. Specifically, the toner does not contact the heat source, and heats the toner on the recording member S by means of the radiation heat from the heat source 23 as mentioned in the second embodiment in detail. Thus, the recording member S is conveyed by the conveyance belt 24 omitting a separation step of separating from the roller or the like.

According to this embodiment, since the second device 12 is arranged downstream of the first fixing device 11 in the recording medium conveyance direction, a highly brilliant image can be obtained by passing through the smoothing step. Since the heat-applying device 11 serves as the first fixing device for softening the toner while applying heat thereto more than a melting point of the toner, the toner is effectively softened. Further, since the pressure applying device 12 serves as the second fixing device for smoothing the toner by transferring the surface condition of the roller to the toner, the toner is more effectively smoothed while suppressing consumption of energy. Because, the heat-applying device 12 does not consume power to receive heat.

According to this embodiment, since the heat applying device 11 include rollers opposing to each other and the roller contacts the recording member S and the toner while conducting and moving heat, the recording member S and the toner are effectively heated. Further, according to the other embodiment, since the recording member S does not contact the roller or the like and receives heat radiation in the heat applying device 12 as shown in FIG. 12, likelihood of the recording member to wind up the roller or the like and not being separated therefrom thereby causing malfunction can be decreased or prevented.

Further, the upper roller 12*a* preferably includes the surface roughness of not more than 0.2 micrometer (Ra). By using such a roller, since the surface roughness is copied onto the toner surface, the toner surface can be more smoothed.

Figure 3:
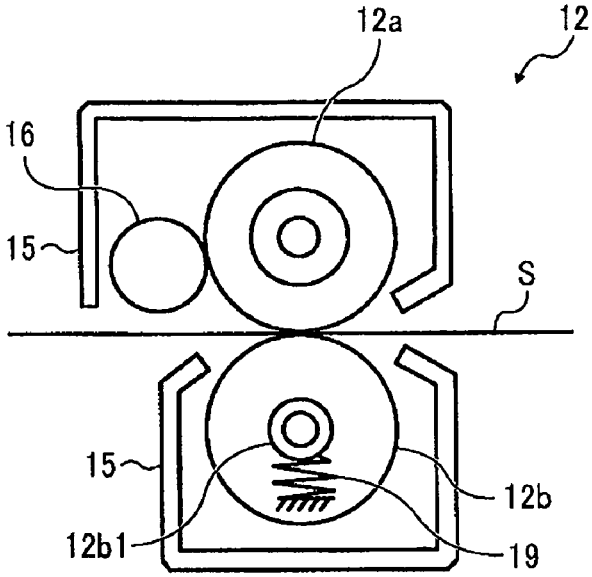
FIG. 3 is a schematic cross sectional view illustrating an exemplary pressure applying device used in a second fixing device included in the image forming apparatus of FIG. 1.

Further, a heat radiation device is preferably provided contacting the upper roller 12*a* as shown in FIG. 3. Specifically, a heat radiation roller 16 is provided contacting the upper roller 12*a* to radiate heat in air, which is transmitted from the heat-applying device 11 and stored in to the upper roller 12*a* via the recording member S and conveyed thereto. Material of the heat radiation roller 16 preferably includes higher heat conductivity than that of the upper roller 12*a*. When the material of the upper roller 12*a* includes stainless, brass or the like is chosen as that of the heat radiation roller 16 so that heat stored in the upper roller 12*a* can effectively be removed. Thus, by providing the heat radiation roller for the roller 12*a* of the heat applying device 12 and radiating the heat conveyed from the heat applying device 11 via the recording member S in air, offset and stein or the like caused on an image surface by temperature increase can be suppressed.

Figure 4:
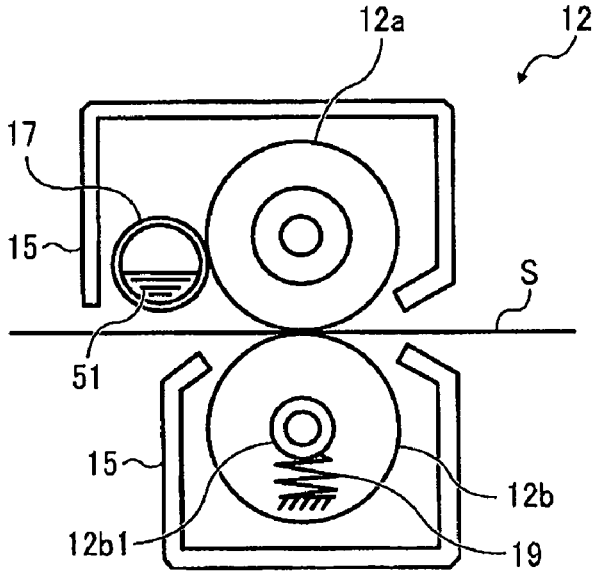
FIG. 4 is a schematic cross sectional view illustrating another exemplary pressure applying device used in the second fixing device of the image forming apparatus of FIG. 1.
Figure 5:
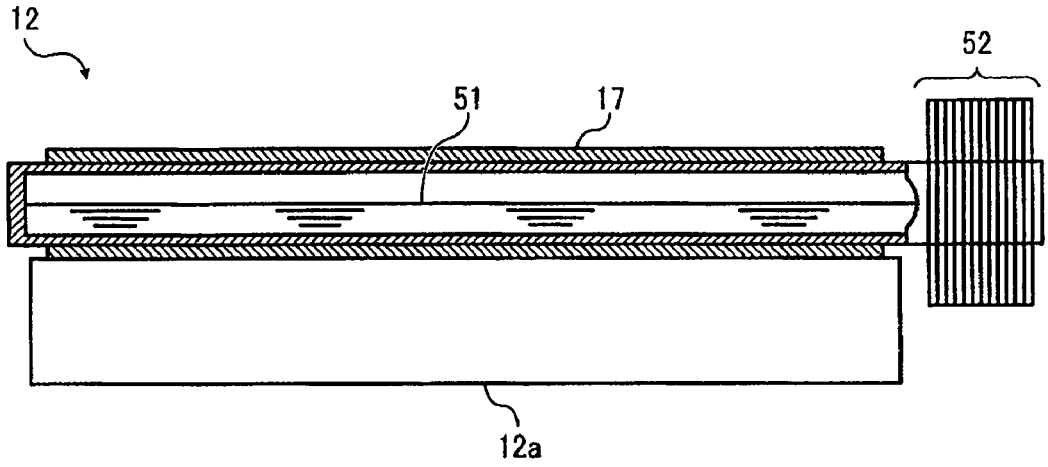
FIG. 5 is a schematic cross sectional view illustrating an exemplary cooling device (a heat pipe) arranged above the pressure-applying device of FIG. 4.

Now, another modification employing a heat radiation roller contacting the upper roller 12*a* is described with reference to FIG. 4. As shown, a heat pipe 17 contacts the upper roller 12*a* contacting the pressure-applying device 12 as a heat radiation roller. Specifically, as shown in FIG. 5, a cooling fan 52 is arranged at one end of the heat pipe 17 where an air of waste heat in the image forming apparatus flows. Since this heat pipe system provides high-speed heat conduction and is excellent in responsibility due to its operation liquid 51 encapsulated in a pipe, the heat storage in the upper roller 12*a* is effectively removed. Specifically, using the heat pipe as the heat radiation device, heat responsibility is excellent and the heat storage can be effective in comparison with heat movement of heat conduction.

Figure 6:
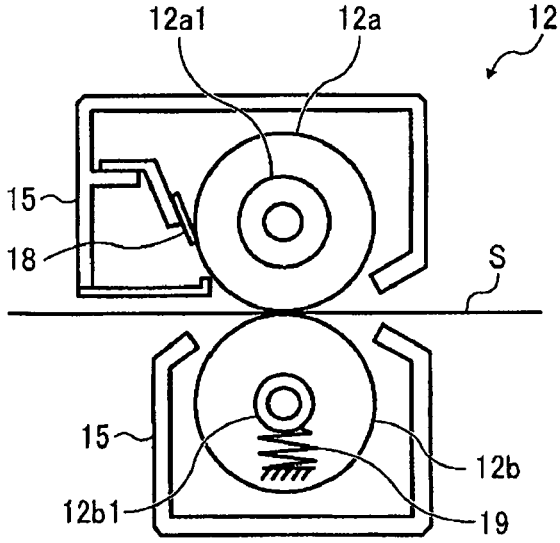
FIG. 6 is a schematic cross sectional view illustrating yet another exemplary pressure applying device used in the second fixing device of the image forming apparatus of FIG. 1.

Now, as shown in FIG. 6, a cleaning blade 18 is preferably provided contacting the upper roller 12*a* of the pressure applying device 12 serving as a second fixing device so as to remove toner sticking to the upper roller 12*a* via the recording member S. As a result, stain sticking to the roller surface can be effectively removed, and a problem, such as a stein, etc., on the image surface caused by the toner sticking to the roller can be prevented.

Figure 7:
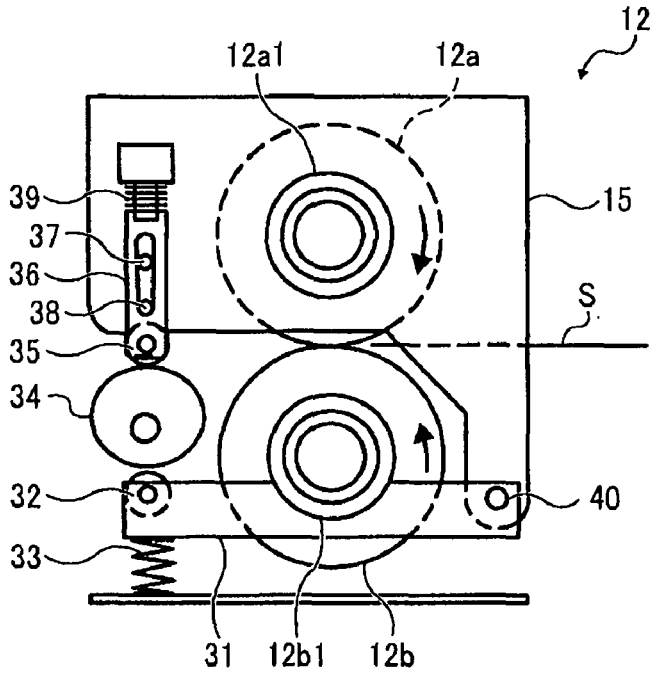
FIG. 7 is a schematic cross sectional view illustrating yet another exemplary pressure applying device used in the second fixing device of the image forming apparatus of FIG. 1.

Further, as shown in FIG. 7, a mechanism is preferably provided to make contact and separate the upper and lower rollers 12*a* and 12*b*. For example, a lever 31 is supported by a fulcrum 40 of a casing 15 of the pressure-applying device 12 at its one end and is biased by a compression spring 33 at the other end. The lever supports a bearing of 12*b*1 of the lower roller 12*b* almost at its center and mounts a roller 32 contacting a cam 34 at the end. Thus, when the cam 34 rotates as a motor, not shown, drives, the lever 31 swings. On the rear side of the cam 34, an arm 36 is provided being supported by plural shafts 37 and 38 being biased by a compression spring 39 arranged in the casing of the pressure-applying device 12. The arm 36 contacts the cam 34 via a roller 35 arranged at its tip. Thus, as the cam 34 rotates, a gap G between the upper and lower rollers 12*a* and 12*b* can be changed. Thus, when a recording member S expected to have brilliance passes, both rollers 12 and 12*b* pressure contact each other.

Whereas when a recording member S expected not to have brilliance passes, both rollers 12*a* and 12*b* are separated from each other. Such a choice of contact and separation can either be designated by a printer driver or the like linking with a type of a recording member or is optionally designated via an operation panel, not shown.

Figure 8:
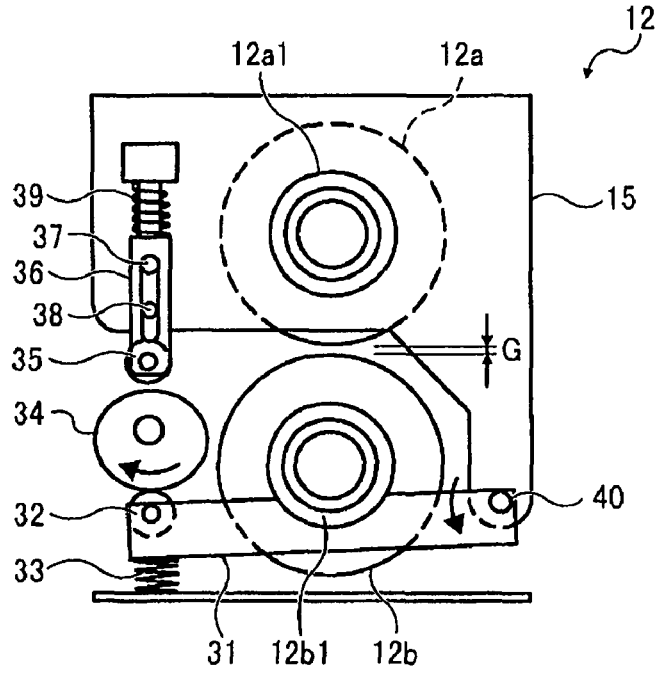
FIG. 8 is a schematic cross sectional view illustrating an exemplary operation of the pressure-applying device of FIG. 7.

Further, as shown in FIGS. 7 and 8, by providing such a mechanism of either making contact of these rollers 12*a* and 12*b* when a recording member S calling for pressure of the pressure applying device passes, or separating those rollers 12*a* and 12*b* when a recording member S not calling for the pressure passes, a plain paper having a monochrome image print can be fixed only by the heat and a recording member not calling for pressure can pass therethrough without external force.

Another modification of the heat-applying device 12 is described with reference to FIG. 9, in which a pair of pressure applying rollers 12*a* and 12*b* does not contact a section where a recording member S passes. In the pressure applying system 12, a bearing 12*b*1 of the lower roller 12*b* pressure contacts a casing 15 of the pressure applying device 15 being biased by the compression spring 33 to maintain a gap G previously set between the upper and lower rollers constant. Accordingly, when a relatively thick recording member S such as a brilliance sheet calling for brilliance passes, both rollers 12 and 12*b* apply pressure. Whereas when a recording member S such as a relatively thinner recording member sheet not calling for brilliance passes, the sheet passes through the gap between both rollers 12 and 12*b* without receiving intensive pressure.

Figure 9:
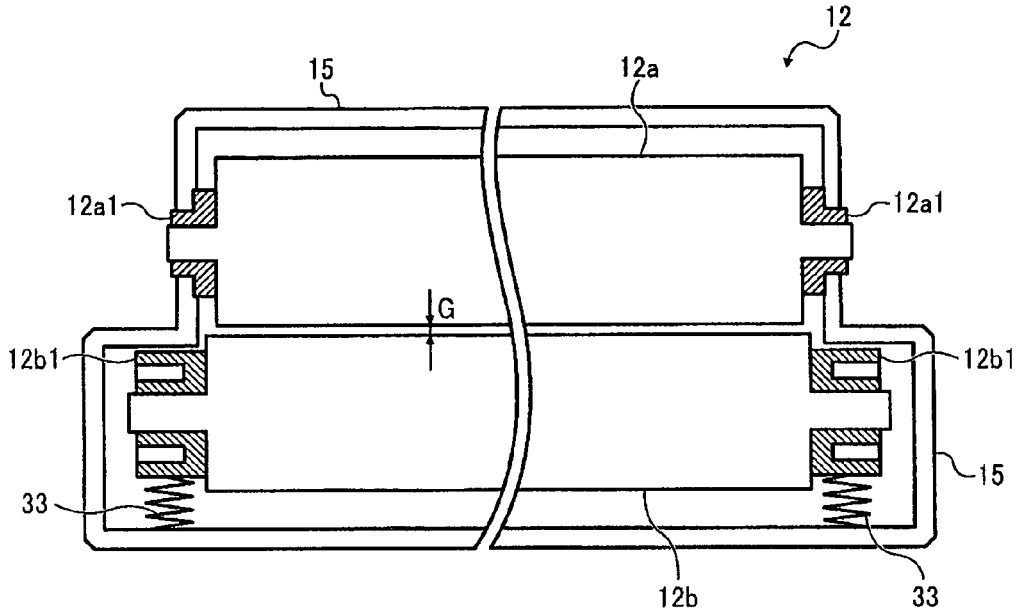
FIG. 9 is a schematic cross sectional view illustrating yet another exemplary pressure applying device used in the second fixing device of the image forming apparatus of FIG. 1.

According to the configuration of FIG. 9, since the gap G is maintained between the opposing rollers in the pressure-applying device 11, the thinner recording medium S than a prescribed level can pass through the gap. Where as when being thicker than the level, the recording member S passes under a prescribed pressure. As a result, in accordance with a thickness of the recording member S, pressure can automatically be changed. Further, since the upper and lower rollers don't contact each other, damage on the roller possibly caused by pinching of alien substance can be prevented.

Figure 10:
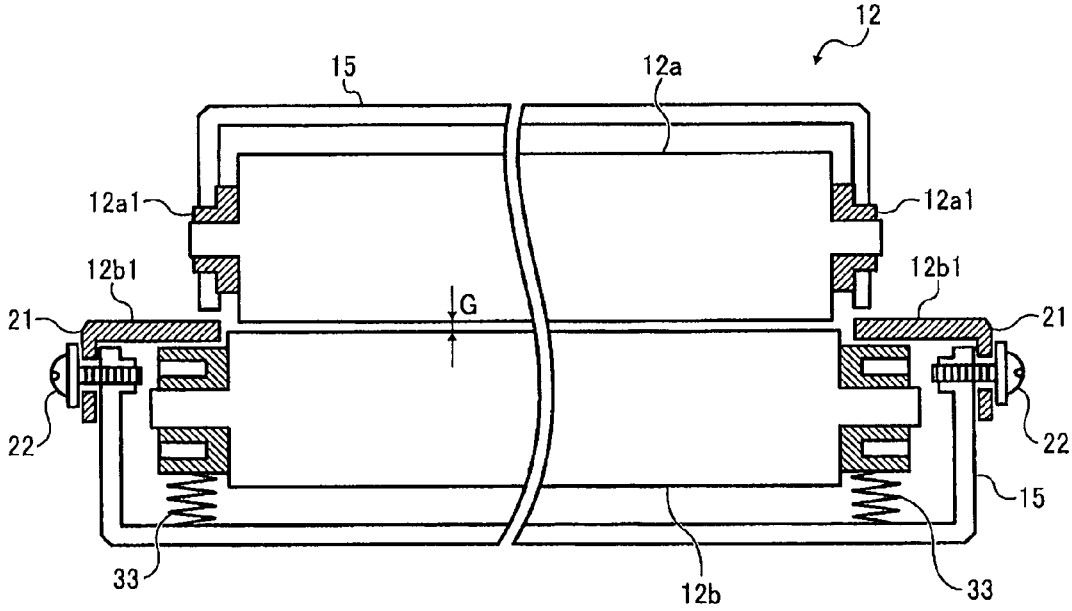
FIG. 10 is a schematic cross sectional view illustrating yet another exemplary pressure applying device used in the second fixing device of the image forming apparatus of FIG. 1.
Figure 11:
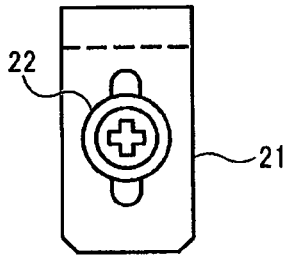
FIG. 11 is a plan view illustrating an exemplary space adjustment member used in the pressure-applying device of FIG. 10.

Now, a still another modification is described with reference to FIG. 10, wherein a gap adjustment member 21 is provided to adjust a gap G formed between the upper and lower rollers 12*a* and 12*b* of FIG. 9. As shown in FIG. 11, a slotted hole is formed on the gap-adjusting member 21 so as to allow adjustment of a securing position of the casing with a screw 22. Thus, since the gap between the upper and lower rollers 12*a* and 12*b* is changed in accordance with the securing position of the gap adjusting member 21, the gap is preferably adjusted in accordance with a relation between a thickness of the recording member S and the necessity brilliance?. Thus, according to the configuration of FIG. 10, since the mechanism capable of changing the gap between the opposing rollers in the pressure-applying device 12, a relation between a thickness of the recording member S and pressure applied by the pressure-applying device can separately be adjusted and optimized.

As a manner of acquiring an image of almost photograph quality, a thermoplastic layer s preferably formed on the surface of the recording member S. Such a thermoplastic layer can include polyethylene, polyolefin such as polypropylene, and acrylic or the like. The material of the plastic layer can include thermoplastic layer as proposed in the Japanese Patent Application Laid Open No. 2006-189605. According to this manner, due to the recording member S having the thermoplastic layer softened by heat applied from the heat-applying device 11, an almost photographic image quality can be obtained.

Now, a second embodiment is described with reference to FIG. 13, in which a versatile image forming apparatus is provided and includes fixing devises that employ heat and pressure applying systems, respectively, arranged in parallel using toner and a recording member as used in a heat fixing system while suppressing energy consumption. Especially, a radiation heat application system is employed in a heat-applying device. Further, a pair of rollers serving as a pressure applying type-fixing device is arranged distant so as not to contact each other so that a problem caused by the contact can be avoided.

Figure 13A:
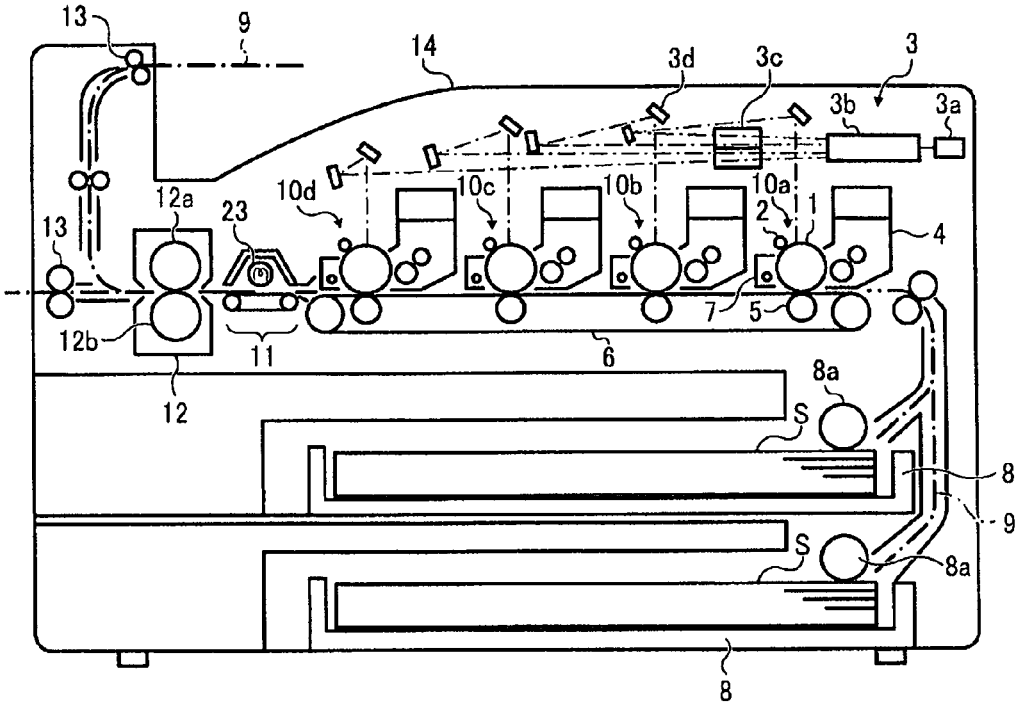
FIG. 13A schematically illustrates an exemplary image forming apparatus of the second embodiment according to the present invention.
Figure 13B:
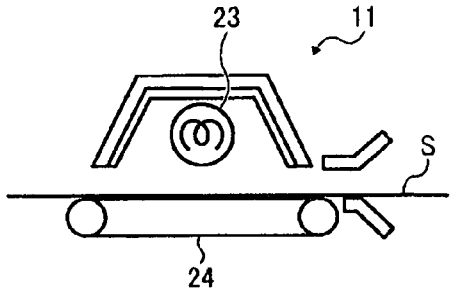
FIG. 13B is a schematic cross sectional view illustrating a heat applying device employing a radiation heat system used in a first fixing device of the image forming apparatus according to the present invention.

Specifically, as shown in FIG. 13, a fundamental configuration and an operation of the image forming apparatus are as same as that of the first embodiment described with reference to FIG. 1. However, the second embodiment features that a heat radiation system is employed in a heat applying device 11 serving as a fixing device. Such a heat radiation system employing heat applying device includes a heat generation member 23 such as an electric heater, a halogen heater, a carbon heater, etc., as discussed in the Japanese Patent Application Laid Open No. 2003-192467 and applies radiation heat to a recording member S passing through a recording member conveyance path 9 as shown in FIG. 13B. A flush lamp can be used as a heat generation source for applying radiation heat. As shown there, a conveyance belt 24 is arranged opposing the heat generation member 23.

Figure 14:
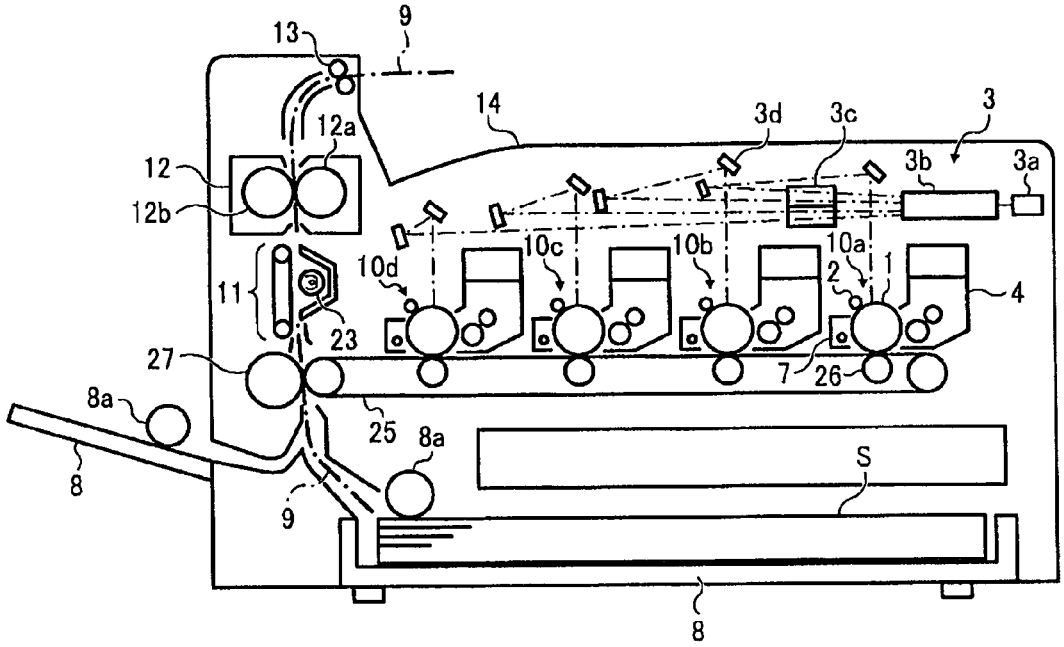
FIG. 14 schematically illustrates another exemplary image forming apparatus of the second embodiment according to the present invention.

As shown in FIG. 14, a modification of the second embodiment of the image forming apparatus is described, in which a fundamental configuration and an operation of the image forming apparatus are as the same as that of the image forming apparatus employing an intermediate transfer system as described with reference to FIG. 12 as described in the first embodiment. Specifically, as shown in FIG. 14, a radiation heat system employing heat applying device 11 is arranged downstream of a second transfer device 27 of the recording member conveyance path 9 in the intermediate transfer system employing image forming apparatus. A pressure-applying device 12 is arranged further downstream of the radiation heat system employing heat-applying device 11.

Since a conventional fixing method of making a roller or a belt contacting a recording member using heat conduction needs a warm up to a prescribed temperature corresponding to a calorie of a recording member before fixing thereof, thereby necessitating a long start up time period. Whereas in the embodiments of FIGS. 13 and 14, since the radiant heat is employed in the heat applying device 11, and accordingly, a warm up time for preheating is extraordinary short as an advantage due to omission of a member intervening the heat generation member 23 and the recording member S. Further, since the heat applying device 11 and the pressure applying device 12 are arranged in parallel, a sufficient fixing performance can be obtained with fine printing quality even if toner is incompletely fixed onto the recording medium S in the heat applying device 11 as far as the toner is somewhat softened. Due to the parallel arrangement of the heat applying device 11 and the pressure applying device 12, a calorie consumed in the process of fixing toner onto the recording member decreases less than the conventional image forming apparatus which fixes with a heat applying device. Further, due to softening the toner by arranging the heat-applying device 11 upstream of the pressure-applying device 12, the image forming apparatus can use toner and a recording member as used not only in the heat application fixing system but also in the pressure application fixing system. Thus, a specification of consumable supplies can be highly versatile.

Figure 15:
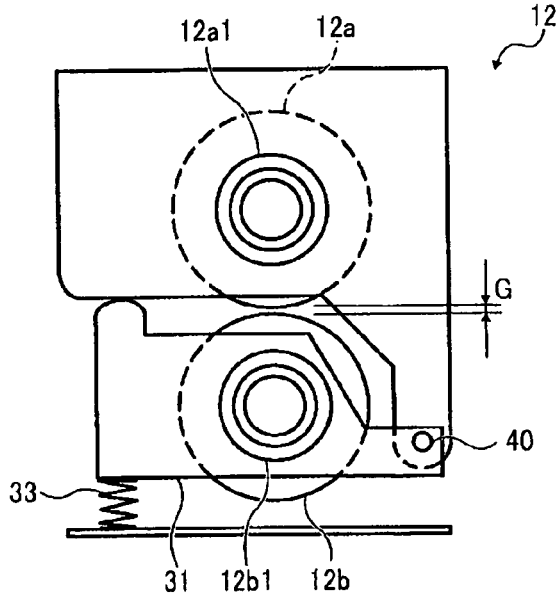
FIG. 15 is a schematic cross sectional view illustrating an exemplary pressure applying device used in the second fixing device of the image forming apparatus of one of FIGS. 13 or 14.

In the image forming apparatus of this embodiment, as shown in FIG. 15, the pressure applying device 12 includes a pair of rollers made of metal having a smooth surface, and is biased by compression springs 33 at its both ends. However, a sheet passage section for a recording member is out of touch.

Specifically, a lever 31 is arranged such that a fulcrum 40 of a casing 15 of the pressure-applying device 12 thereof supports one end, and the other end is supported by a compression spring 33. The lever 31 supports a bearing 12*b*1 of the lower roller 12*b* at its center.

A protrusion is arranged at the end of the lever 31 and contacts the casing that supports the bearing 12*a*1 of the upper roller 12*a* so that a gap G between a pair of pressure applying roller can be maintained at a prescribed level. The gap G is narrower than the thickness of the recording member S, and accordingly, toner softened by the heat-applying device 11 is fixed under a pressurizing force.

In this way, by employing pair of non contact pressure applying rollers 12*a* and 12*b*, a damage on the surface of the pressure applying roller possibly caused by pinching of an alien substance or the like can be avoided and the life of the roller can be prolonged. Further, when the pair of pressure applying rollers contact (each other) while high pressure is applied, a recording member having a low rigidity tends to have wrinkle, and is sometimes torn along the wrinkle. However, since a pressure applied to the recording member is relatively small, the damage can be not serious. Thus, occurrence of the wrinkle and tearing of the recording member caused by the wrinkle can be suppressed.

Figure 16:
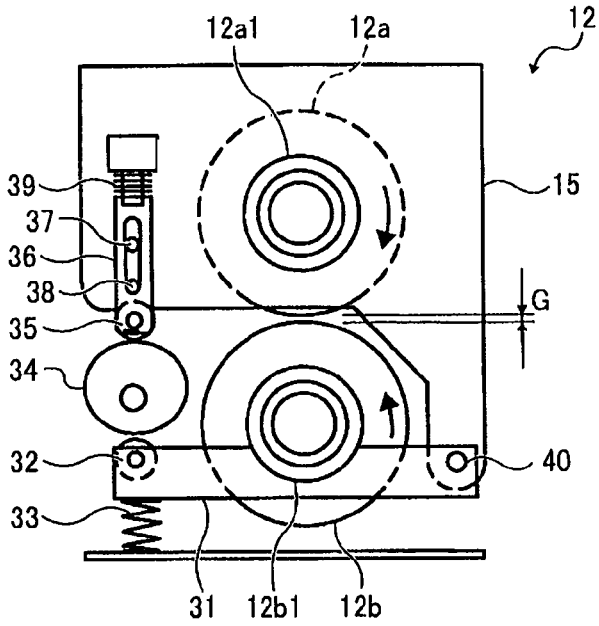
FIG. 16 is a schematic cross sectional view illustrating another exemplary pressure applying device used in the second fixing device of the image forming apparatus of one of FIGS. 13 or 14.
Figure 17:
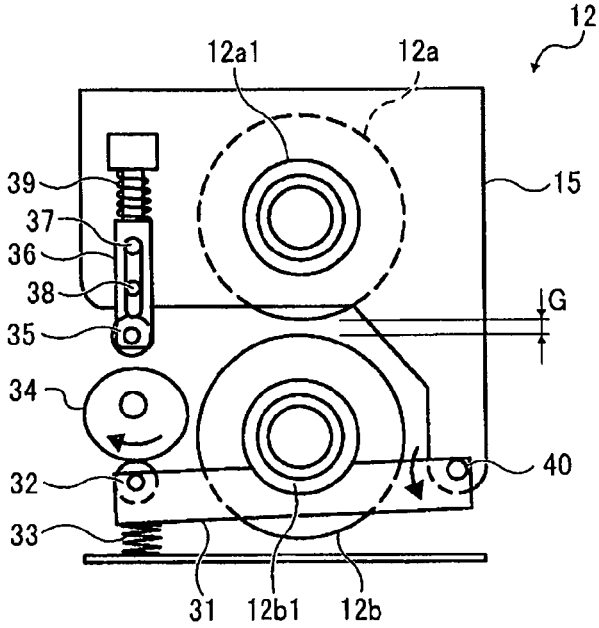
FIG. 17 is a schematic cross sectional view illustrating an exemplary operation of the pressure-applying device shown in FIG. 16.

Further, as shown in FIG. 16, the passage section for the recording member in the pressure applying device 12 that includes the contact and separation mechanism as shown in FIGS. 7 and 8 is described. Specifically, in FIG. 7, the upper and lower rollers 12*a* and 12*b* of the pressure-applying device 2 are contacted and separated. Whereas in FIG. 16, both of the upper and lower rollers are always not contacted by the adjustment of an attaching position of the arm 36. Specifically, as the cam 34 rotates, these rollers are separated from an adjacent condition of FIG. 16 to a separation condition of FIG. 17. In the pressure applying device 12 of FIGS. 16 and 17, when the cam 34 rotates to a position as shown in FIG. 16 as a motor, not shown, starts driving in accordance with information inputted by an operator through an operation panel, not shown, the gap G between the pair of pressure applying rollers 12*a* and 12*b* can be narrowed. Whereas when the cam 34 rotates to a position as shown in FIG. 17 as the motor starts driving, the gap G is broadened. Then, by setting the gap G of the pair of pressure applying rollers to slightly be less than the thickness of the recording member S, the almost same pressurizing force is applied independent from the thickness of the recording member S. Further, the gap G can be gradually changed by rotating and stopping the cam 34 at a prescribed angle.

Now, an exemplary configuration and an operation of still another modification of the pressure-applying device 12 are described with reference to FIGS. 18 and 19. As shown, and similar to the configuration of FIG. 9, the bearing 12*b*1 of the lower roller 12*b* of the pressure applying device 12 is depressed by the compression spring 33 and contact the casing 15 of the pressure applying device, so that a prescribed gap G between the upper and lower rollers 12*a* and 12*b* can be maintained at a prescribed level. However, a cam 41 is controlled by a motor, not shown, to rotate to either contact or separate from the bearing 12*b*1 of the lower roller 12*b*.

Figure 18A:
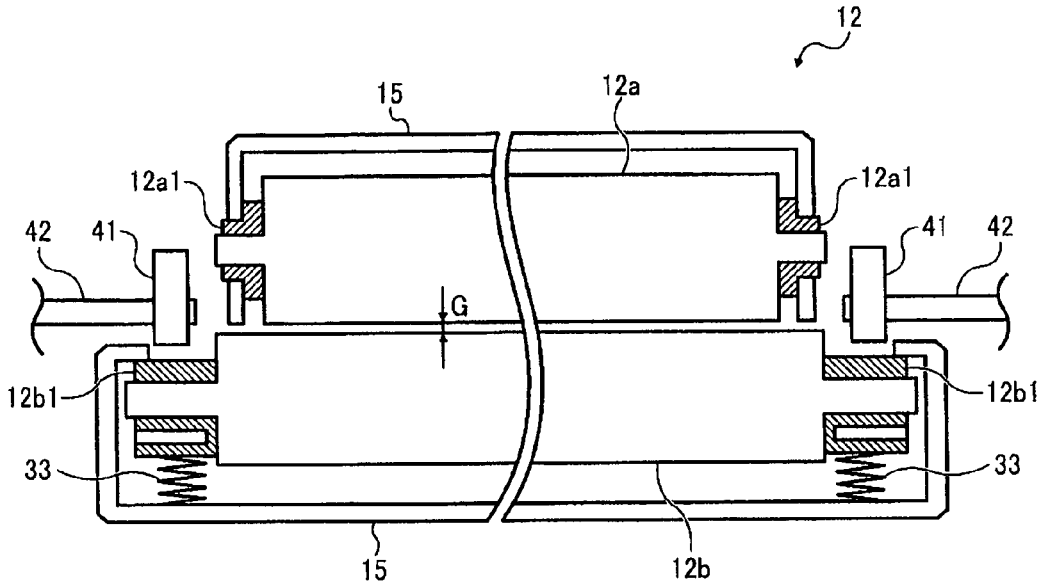
FIGS. 18A and 18B are schematic cross sectional views collectively illustrating another exemplary pressure applying device used in the second fixing device of the image forming apparatus of one of FIGS. 13 or 14.
Figure 18B:
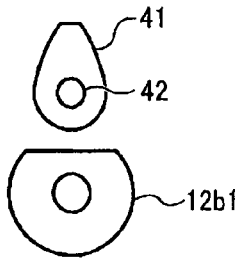
Figure 19A:
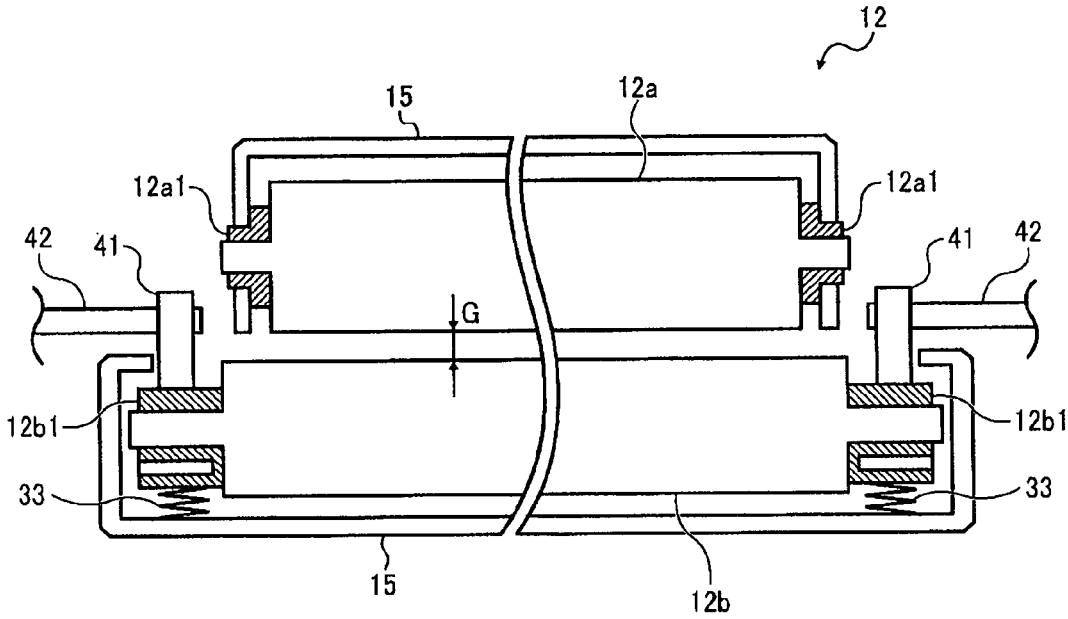
FIGS. 19A and 19B collectively illustrates an exemplary operation of the pressure-applying device shown in FIG. 16.
Figure 19B:
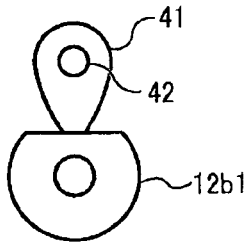

As shown, when the cam 41 rotates to a position separated from the bearing 12*b*1 as shown in FIG. 18B, the bearing 12*b*1 is pressurized to the casing 15 of the pressure applying device 12 by the spring 33, so that the gap G is narrowed. Further, when the cam 41 rotates to a position and contact the bearing 12*b*1 as shown in FIG. 19B, the bearing 12*b*1 is displaced downward by the cam 41 against the bias of the compression spring 33 and held, so that the position of the bearing and the gap G is broadened. The gap G can be changed by another mechanism other than the combination of the above-mentioned motor and the cam.

Further as shown in FIG. 13, plural mechanisms 8 are preferably arranged to stack and launch plural recording members S to a recording member conveyance path, while providing a control device, not shown, for controlling the gap G of the pair of pressure applying rollers of the pressure applying device 12 linking with a sheet feeding device 8 selected by an operator. By predetermining a type and a thickness of recording members S stacked on the sheet-feeding device 8, the gap G of the pair of pressure applying rollers can be automatically designated in accordance with the type and the thickness. Specifically, since the gap G is changed in accordance with the selection of the sheet-feeding device 8 feeding the recording member S, the type and the thickness of the recording member S stacked on the sheet-feeding device 8 can correspond to the gap G beforehand. Thus, the gap G can be automatically changed to be optimum in accordance with each of the recording members.

Further, a detecting device for automatically detecting a thickness of the recording member S is provided, and the gap G can be changed based on the detection information as discussed in the Japanese Patent Application Laid Open No. 8-262921. Specifically, an electrophotographic recording apparatus transfers a toner image sticking to an image formation carrier onto a sheet using a transfer device, and fixes and performs printing thereof using a heat-fixing device arranged on a sheet conveyance path. Also arranged are a roller to pinch the sheet having a prescribed resistance in the upstream of the fixing device, a current supplying device for supplying a constant current to the roller, and a detecting device for detecting a load voltage created when the constant current is supplied. Further included is a control device for controlling temperature of the fixing device based on the load voltage detected by the detecting device. Specifically, in accordance with a relation between the constant current supplied and the load voltage, either a method of detecting the thickness of the recording member S or the other conventional detection method can selectively be used.

By arranging the detection device that detects the thickness of the recording member and automatically optimizing the gap G of the pair of pressure applying rollers of the pressure-applying device 12 in accordance with the thickness of the recording member detected, a constant pressurizing force can be applied to the recording member S regardless of the thickness thereof. As a result, a problem, such as wrinkle of a recording member due to application of an excessive pressurizing force, fixing malfunction due to an insufficient pressurizing force of a fixing performance, etc., can be avoided.

In the image forming apparatus capable of forming an image of multi colors as shown in FIGS. 13 and 14, it is preferably determined based on information transmitted from a control device included in the exposure device 3, not shown, if an image to be formed on the recording member S is either a monochrome or a multicolor, so that a gap G between the pair of pressure applying rollers of the pressure-applying device 12 is preferably changed to be appropriated for the respective images. Since the multi color image necessitates a more attraction amount of toner than the monochrome image and forms a thicker toner layer, the gap G is set larger when the monochrome image is formed, and smaller when the multi color image, respectively, so that a pressurizing force is appropriate for respective image patterns.

Thus, by providing the control device that determines if the image is either monochrome or multi color and automatically changing the gap to the optimized level in accordance with a difference of the image on the recording member S, a problem of insufficient fixation due to an insufficient pressurizing force and that caused by an excessive pressurizing force can be suppressed.

Further, in the image forming apparatus, an area rate of an image transferred onto the recording member S is preferably determined based on information from the control device 3, and the gap G between the pair of pressure applying rollers of the pressure-applying device 12 can be changed to be appropriate for the images. Since the amount of toner attracting to recording member S and a thickness of the toner layer are in proportion to the image area rate, the gap G is set larger when the image area rate is not more than 50%, and smaller when not less than 50%, respectively, so that a pressurizing force is appropriated for respective image area rates. A boarder of the image area rate determining the gap can be appropriately determined in accordance with specifications of the heat applying device 11, the pressure applying device 12, and toner or the like.

Thus, by determining if the image area rate (i.e., a printing rate) of the recording member S exceeds a prescribed level and automatically changing the gap to the optimized level in accordance with the image area rate, a problem of insufficient fixation due to an insufficient pressurizing force and that caused by an excessive pressurizing force can be suppressed.

Now, a third embodiment is described with reference to FIG. 20. In this embodiment, fixing devices employing a heat and pressure applying systems, respective, are arranged in parallel to provide a versatile configuration that uses toner and plain paper as generally used in a heat fixing system while decreasing a start up time period and saving energy. Further, both of a transfer and heat applying steps are provided along the recording member conveyance belt so as to soften the toner to be carried on the conveyance belt before a recording member is separated there from, so that an image forming apparatus can suppress toner scatter and image disturbance at the time of the toner separation. Further, the pair of pressure applying rollers employing the pressure applying system of the fixing device are separated to suppress a problem of a cut or the like caused by contact of those.

Figure 20:
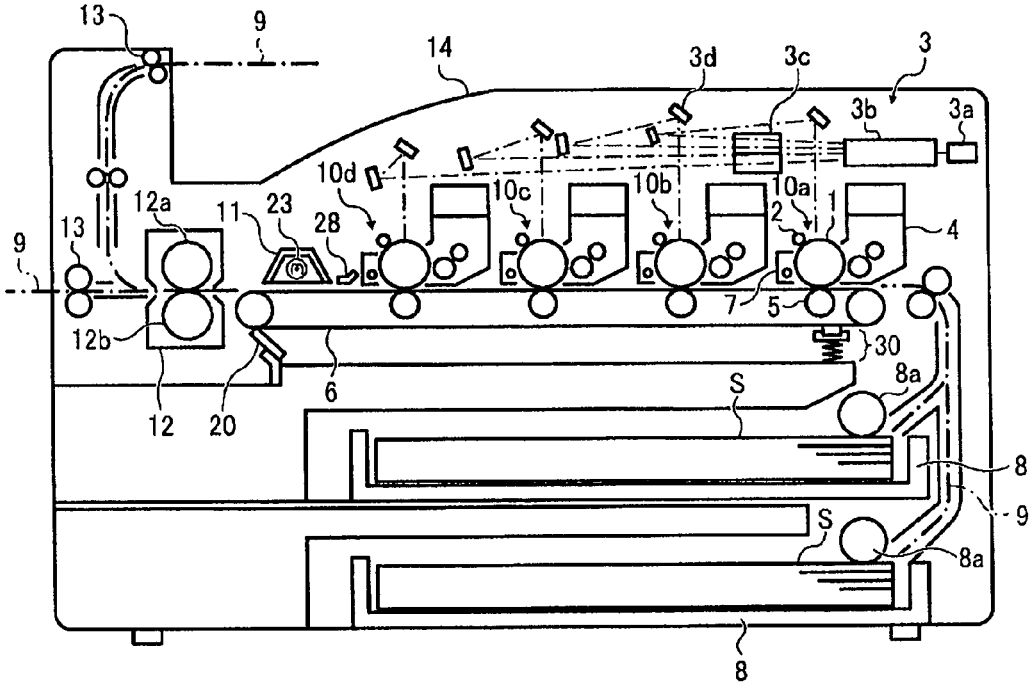
FIG. 20 schematically illustrates an exemplary image forming apparatus of the third embodiment according to the present invention.

Specifically, in FIG. 20, the fundamental configuration and an operation of the image forming apparatus are substantially the same as the image forming apparatus of the first embodiment. However, in this embodiment, a heat-applying device 11 that applies radiation heat as that in the second embodiment is utilized as a first fixing device. Further, a transfer device 5 and a heat applying device 12 applying heat are arranged along the circumferential surface of the same recording member conveyance belt 6 (a transfer belt in FIG. 20).

More specifically, in the image forming apparatus of FIG. 20, transfer and conveyance use conveyance belt (transfer belt) 6 is arranged above the conveyance pass 9 for the recording member S to transfer a toner image on the photoconductive members 1 of respective image formation sections 10*a* to 10*d* onto the recording member S fed from a sheet feeding section (a recording member stacking section) 8. The heat-applying device 11 is arranged in the vicinity of the outer circumference surface of the transfer belt 6 downstream of the image formation section 10*d* so as to soften the non-fixed toner on the recording member S with the radiation heat. The recording member S is separated from the transfer belt 6 and enters the pressure-applying device 12. The recording member S is then pressurized so that the toner image can be fixed onto the recording member S. The transfer belt 6 can be made of high heat resistant material such as PAI (polyimide), etc. A heat generation member (i.e., a heat generation source) 23 provided in the heat applying device 11 can employ a light emitting device such as halogen heater, etc. Otherwise, a flash-fixing device is used.

Figure 21:
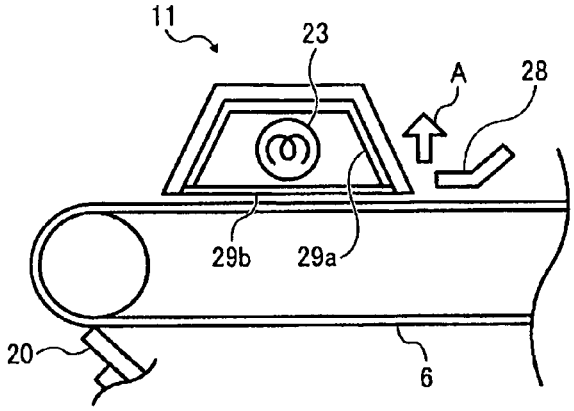
FIG. 21 is an enlarged schematic cross sectional view illustrating an installation section of the heat applying device of the radiation heat system used in the image forming apparatus of FIG. 20.

A shown in FIG. 21, a toner attraction plate 28 is arranged at the entrance to the heat generation member 23 to electrostatically attract toner floating from the recording member S after a transfer process in order to avoid contamination of the heat-applying device 11.

Figure 22:
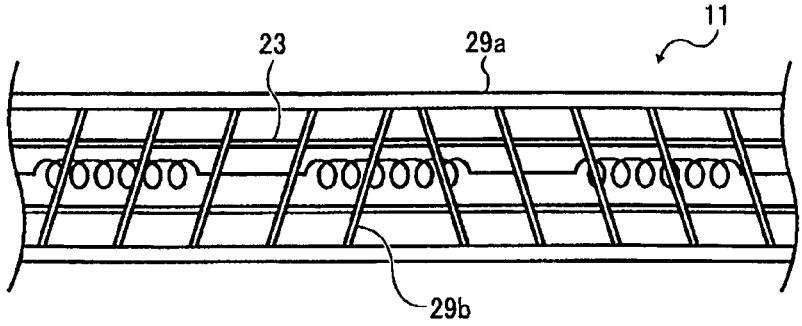
FIG. 22 illustrates an exemplary case opening section and a guide included in the heat-applying device of the radiation heat system shown in FIG. 21.

Further, an air flow A is created in a gap between the toner attraction plate 28 and the heat applying device 11 in a sheet ejection direction from the recording member conveyance path 9 by a fan, not shown, so that the toner floating around the heat generation member 23 is removed from the recording member conveyance path 9. Even though, the recording member S tightly contacts and is conveyed by the transfer belt 6 and the tip thereof is accidentally separated therefrom by some reasons, the tip is guided by a grid state guide 29*b* arranged at an opening section of a casing 29*a* of the heat generation member 23 with a reflection plate as shown in FIGS. 21 and 22. Thus, the recording member S does not contact the heat generation member 23 and has almost no chance to cause fire or smoke. The guide 29*b* can employ metal wire and that with hair implantation or the like.

Further, a cleaning blade 20 is preferably arranged in an image forming apparatus of FIG. 20 to contact the circumference of the transfer belt 6 to remove toner transferred due to sheet jam and that directly transferred thereonto at times of color deviation and density correction operations. Further, a lubricant coating device 30 for coating the transfer belt with lubricant, such as zinc stearate, etc., is preferably arranged downstream of the cleaning blade 20.

Now, a modification of the image forming apparatus of the third embodiment is described with reference to FIG. 23.

Specifically, the fundamental configuration and an operation of the image forming apparatus are substantially the same as the image forming apparatus of the first embodiment that employs the intermediate transfer system as shown in FIG. 12. However, in FIG. 14, in the image forming apparatus of the intermediate transfer system, a heat applying device 11 employing a heat radiation system is arranged downstream of a secondary transfer device 27 on the recording member conveyance path 9, and a pressure applying device 12 is arranged further downstream thereof.

In such a situation, along the circumference surface of the common conveyance belt 24, the secondary transfer device 27 for the toner and heat applying device 11 are arranged to soften the toner carried on the conveyance belt 24 before the recording member S is separated therefrom, so that scatter of the toner and disturbance of an image can be avoided.

Figure 23:
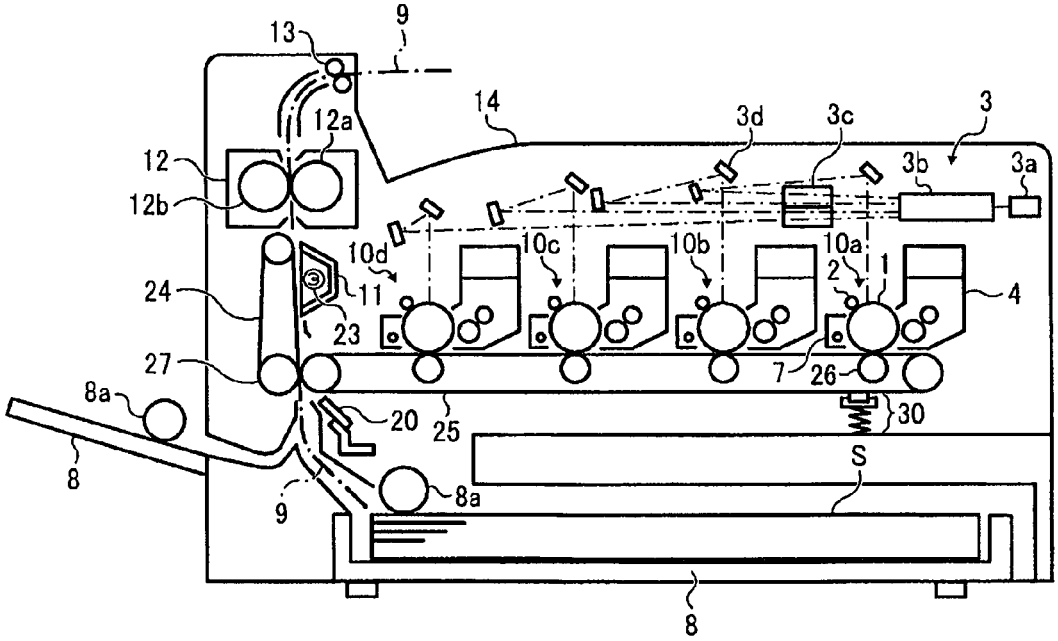
FIG. 23 schematically illustrates another exemplary image forming apparatus of the third embodiment according to the present invention.

Further, as shown in FIG. 20 or FIG. 23, since radiation heat is employed by the heat applying device 11 as in the second embodiment and none of members intervene the heat generation member 23 and the recording member S, a time period needed for preheating is minimized, so that the image forming apparatus can quickly start up. Further, even if toner cannot completely be fixed onto the recording medium S by the heat applying device 11, a sufficient fixing performance can be obtained by collaboration of the heat applying device 11 and the pressure applying device 12 arranged in parallel as far as the toner is soften by a certain degree. Thus, a finer quality can be obtained than the conventional image forming apparatus that simply employs the heat-applying device. Further, since the heat applying device 11 and the pressure applying device 12 are arranged in parallel, a calorie is less consumed in a fixing process for fixing toner onto a recording member than in a conventional image forming apparatus only using a heat applying device. Further, since the transfer and heat applying processes are executed on the circumference of the common conveyance belt (either the transfer belt 6 or the conveyance belt 24), toner is carried maintaining softness even after the heat applying process. Thus, the toner on the recording member does not electrostatically scatter and disturb an image when the recording member is separated from the conveyance belt.

In addition to the above-mentioned configuration, a cooling device is preferably arranged contacting the outer circumference surface of the conveyance belt (either the transfer belt 6 of FIG. 20 or the conveyance belt 24 of FIG. 23). By contacting the cooling device with circumference surface of the conveyance belt, heat traveling from the heat-applying device 11 to the conveyance belt can be radiated. Thus, since only a small amount of heat travels from the conveyance belt to the photoconductive member or the like in the next transfer process, deterioration can be avoided and life of parts can be prolonged.

Figure 24:
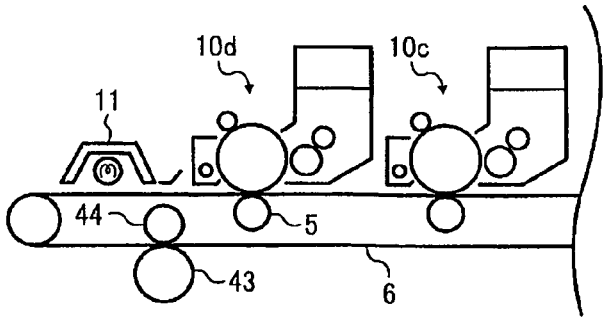
FIG. 24 schematically illustrates another exemplary image forming apparatus of the third embodiment according to the present invention.
Figure 25:
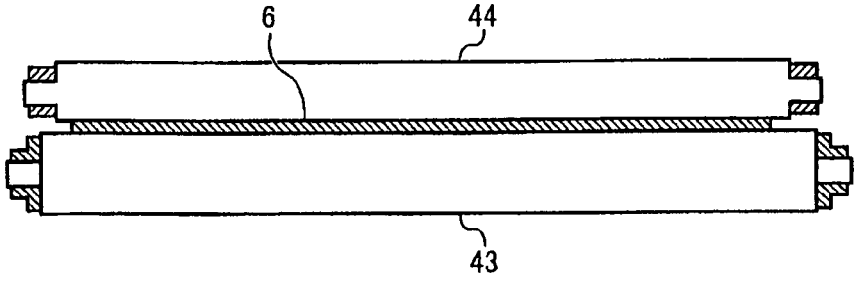
FIG. 25 schematically illustrates an exemplary transfer belt-cooling device included in the image forming apparatus of FIG. 24.

Now, an outline of the image forming apparatus including the cooling device is described with reference to FIGS. 24 and 25. As shown, an opposing roller 44 is arranged on the rear side of the transfer belt 6 downstream of the heat applying devices 11. A radiation roller 43 is provided as the cooling device to contact a section of the outer circumference surface of the belt opposing the opposing roller 44, so that heat of the transfer belt 6 is moved to the heat radiation roller 43 and is radiated into air. The heat radiation roller 43 is made of metal or material preferably having high heat conductivity. Since the cooling device of FIGS. 24 and 25 is made of the metal, a cooling system can save cost with a simple construction. The cooling device is not limited to such a roller type and can be a planar state member that contacts and scrapes the transfer belt 6.

Figure 26:
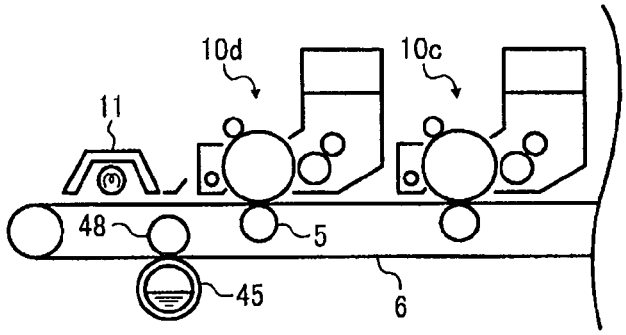
FIG. 26 schematically illustrates another exemplary image forming apparatus of the third embodiment according to the present invention.
Figure 27:
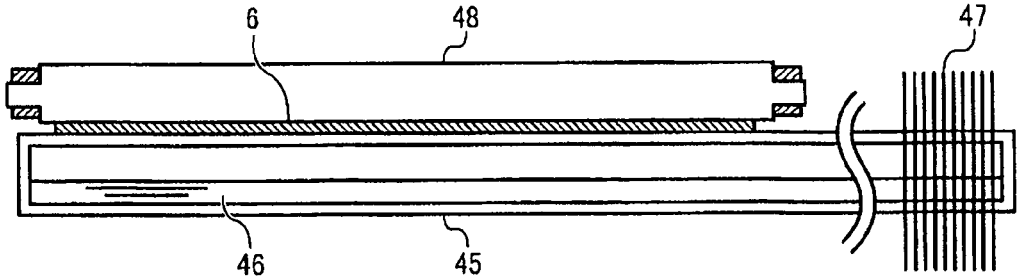
FIG. 27 schematically illustrates an exemplary transfer belt-cooling device included in the image forming apparatus of FIG. 26.

Now, a modification of the image forming apparatus including the cooling device is described with reference to FIGS. 26 and 27. As shown, an opposing roller 48 and a heat pipe 45 are provided downstream of the heat-applying device 11 on the transfer belt 6. The heat pipe 45 contacts the outer circumference surface of the transfer belt 6. A heat radiation fin 47 is provided at one end of the heat pipe 45 to radiate heat traveling from the transfer belt 6 to the heat pipe 45 via an operation liquid 46 into air. Thus, by employing the heat pipe 45 as a cooling device, heat conveyance can be efficient and the transfer belt can be efficiently cooled down.

Figure 28:
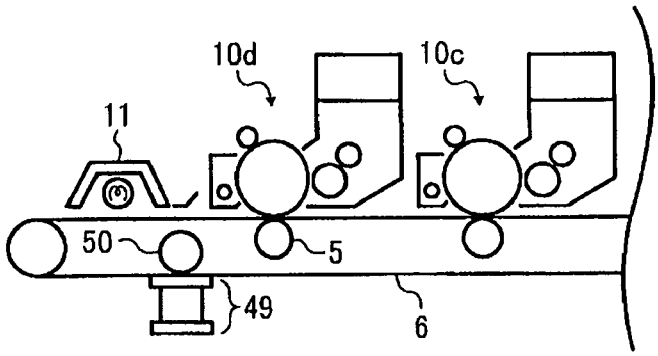
FIG. 28 schematically illustrates another exemplary image forming apparatus of the third embodiment according to the present invention.
Figure 29:
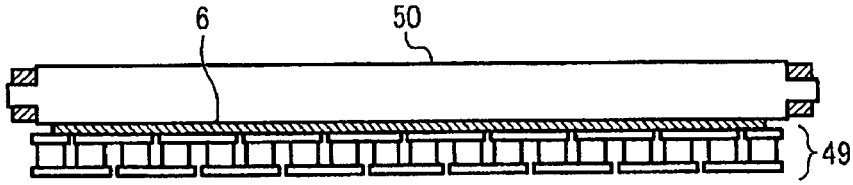
FIG. 29 schematically illustrates an exemplary transfer belt-cooling device included in the image forming apparatus of FIG. 28.

Now, still another configuration of the image forming apparatus having the cooling device is described with reference to FIGS. 28 and 29. As shown, an opposing roller 50 and a thermo module 49 are arranged downstream of the heat-applying device 11 on the conveyance belt 6.

Figure 30:
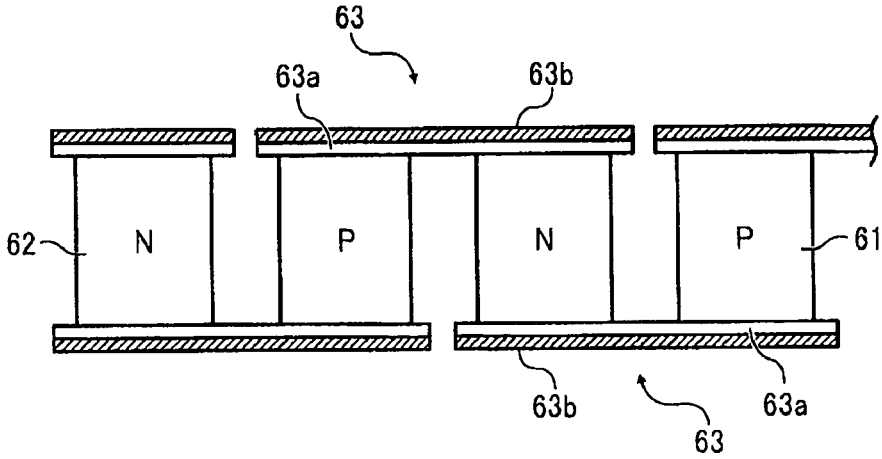
FIG. 30 is an enlarged view illustrating an essential part of the transfer belt-cooling device of FIG. 29.
Figure 31:
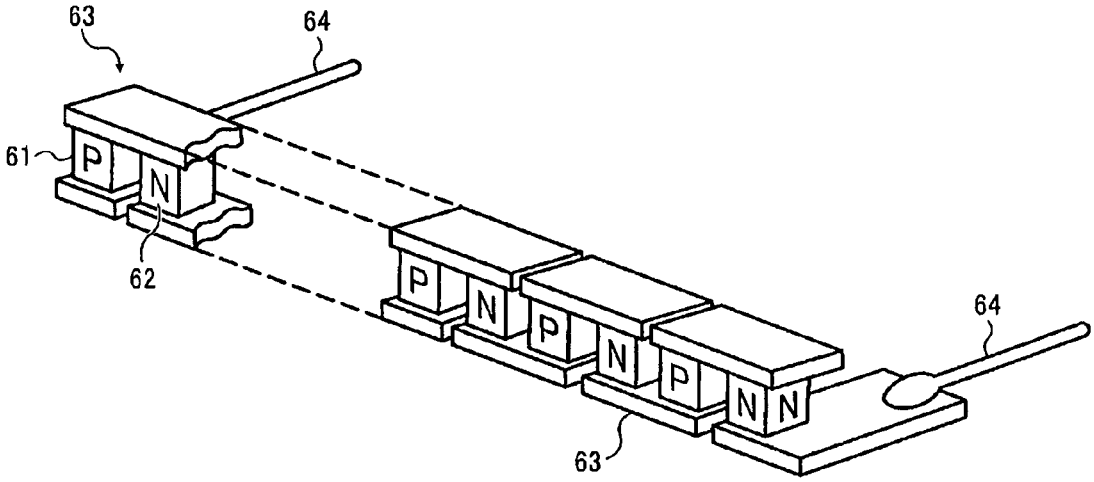
FIG. 31 is a perspective view schematically illustrating the transfer belt-cooling device of FIG. 29.

Specifically, the thermo module 49 contacts the outer circumference surface of the transfer belt 6, so that heat moved from the transfer belt 6 to the thermo module 49 is radiated into air via a heat radiation section, not shown. An exemplary thermo module 49 is described in the Japanese Patent Application Laid Open No. 2001-267641 such that plural P and N type semiconductor elements 61 and 62 are arranged one after another as shown in FIGS. 30 and 31. The plural P and N type semiconductor elements 61 and 62 are then serially electrically connected by an electrode 63 including a conductive section 63*a* and an insulation section 63*b*, and are then connected to a power source or the like via a lead wire 64. However, the thermo module 49 is not limited to the above and can include various modifications.

To more precisely contact the heat radiation roller 43, the heat pipe 45, and the thermo module 49 with the transfer belt 6 in such a configuration with the various cooling device, plural opposing rollers 44, 48, and 50 are preferably arranged as shown in FIGS. 24 to 28.

As in the first and second embodiments, a contact and separation mechanism and a gap adjustment mechanism or the like are provided for the pair of pressure applying rollers 12*a* and 12*b* of the pressure applying device 12 in the image forming apparatus in this embodiment. For example, as illustrated in FIGS. 18 and 19, the gap adjustment mechanism including the compression spring 33, the cam 41, and the motor or the like are arranged as a mechanism more precisely adjusting the gap between the pair of pressure applying rollers as described in the second embodiment. Specifically, in accordance with the rotational position of the cam 41 secured to the shaft 42 of a motor, not shown, the gap G can be maintained at a prescribed level. For example, when the gap G is smaller than the thickness of the recording member S, toner softened by the heat-applying device 11 is fixed receiving the pressurizing force.

Further, in accordance with information inputted by an operator through an operation panel, not shown, of an image forming apparatus, the cam 41 is rotated by a driving force of a motor, not shown, either to a position of FIG. 18 so that the gap G decreases or that of FIG. 19 so that the gap G increases. By always setting the gap G to be slightly smaller than the thickness of the recording member S, the same pressurizing force is applied thereto regardless of the thickness of the recording member S. The cam 41 can be stopped when rotated with a prescribed angle, so that the gap G is changed stepwise. Instead of the combination of the motor and the cam used in this embodiment, the other method can be employed to change the gap G.

Also in the image forming apparatus of this embodiment, since the gap of the pair of pressure applying rollers of the pressure-applying device 12 can be changed in accordance with the thickness of the recording member S as in the second embodiment, a constant pressurizing force can be applied to the recording member. Thus, a problem of insufficient fixation due to an insufficient pressurizing force and that of wrinkle or the like of the recording member caused by an excessive pressurizing force can be resolved. Further, the gap of the pair of pressure applying rollers is preferably changed to be a prescribed level in accordance with the selection of the sheet-feeding device 8 that feeds the recording member S. By designating correspondence between the type or thickness of the recording member S stacked on the sheet feeding device and the gap beforehand, the optimum gap can be automatically obtained in accordance with the respective recording members.

Further, as in the second embodiment, a detecting device for detecting a thickness of the recording member S can be provided, and the gap G can automatically be changed to the optimum value in accordance with the thickness.

Further, by providing a control device that determines if an image is either monochrome or multi color, the gap is automatically changed to the optimized level in accordance with a difference of a print on the recording member S.

Further, by providing a control device capable of determining if the image area rate (i.e., a printing rate) of the recording member S exceeds a prescribed level, the gap can automatically be changed to the optimized level in accordance with the image area rate.

Now, a fourth embodiment is described with reference to FIG. 32.

In this embodiment, heat and pressure applying devices are arranged in parallel as a fixing device as in the third embodiment. However, the heat-applying device employs an electromagnetic induction heating system so as to only apply heat to toner other than a member of the heat applying roller or a recording member in order to save energy.

Further, by omitting members such as a heat applying roller, etc., intervening a magnetic field creating source included in the electromagnetic induction heating system and toner, preheat therefor can be omitted so that a start up time period can further be decreased.

Further, by omitting application of heat to a recording member (paper), a problem, such as sheet curl after its ejection, transfer malfunction in second side printing of a duplex printing operation due to decrease of moisture content during the first surface fixation can be prevented. Further, by executing a transfer step and a fixation heat-applying step by means of electromagnetic induction on the same circumference surface of the conveyance belt, an attraction force of toner to the recording member is created. Image deterioration such as toner scatter caused when the toner is separated from the conveyance belt can be prevented. Further, by dividing the electromagnetic induction-heating device and controlling current to flow through respective coils in accordance with a width of the recording member, needless power consumption can be suppressed saving energy.

Further, a section of pair of pressure applying rollers of the pressure applying device where a recording member passes through is not contacted each other and a gap is formed as in the first to third embodiments, a cut on the surface of the pair of pressure applying rollers can be suppressed, thereby life of the parts can be prolonged.

Since toner is provisionally heated on the conveyance belt right after transfer of tone onto a recording member in this embodiment, a region for heating the toner on the recording member can be broader in comparison with a nip section between rollers of a conventional heat and pressure applying fixing system even if it is applied to an image forming apparatus operating at high speed at a linear speed such as more than 300 mm/sec. In addition, temperature of the toner on the recording member is precisely increased to a glass transition level to be softened and melted, while conveying the recording member to a pair of pressure applying rollers arranged downstream of the recording member conveyance direction. Thus, a fixation malfunction can be avoided.

Figure 32:
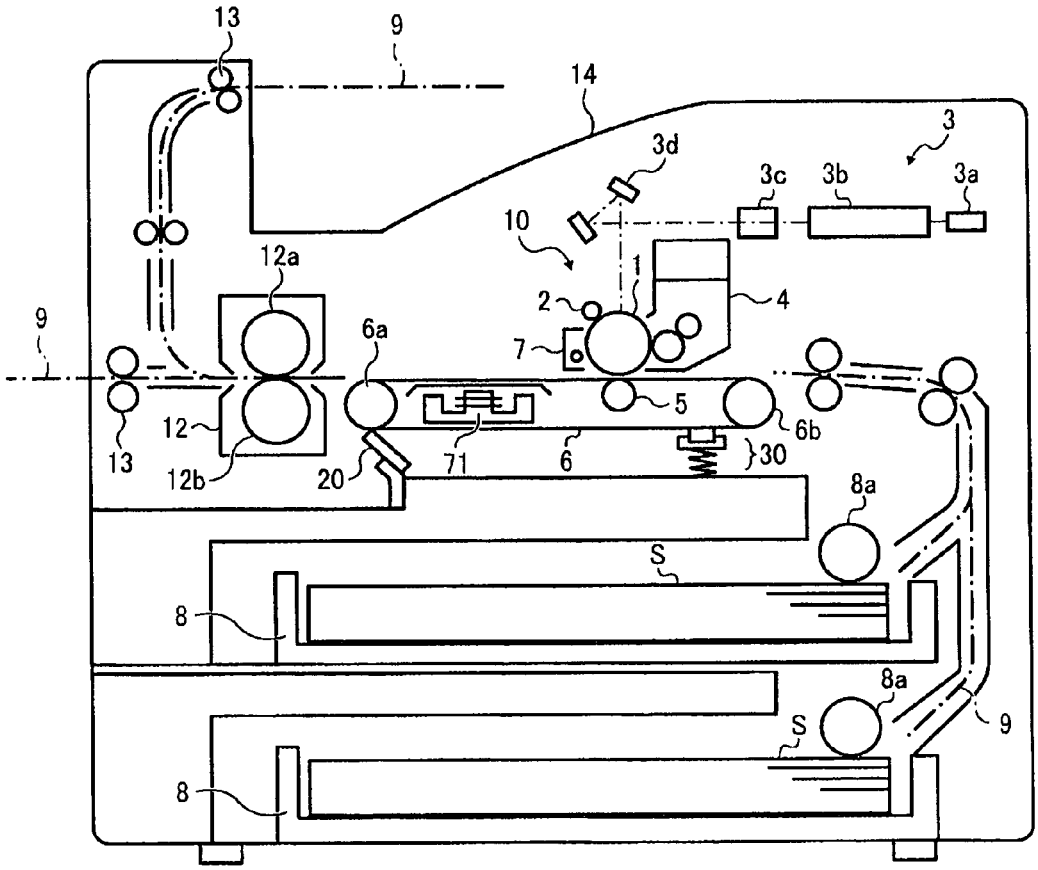
FIG. 32 schematically illustrates an exemplary image forming apparatus of the fourth embodiment according to the present invention.

As shown in FIG. 32, an exemplary image forming apparatus includes a monochrome machine having a single image formation section 10 along a conveyance belt (a transfer belt) that carries and conveys a sheet like recording member S. The image formation section 10 includes a drum type photoconductive member 1 as an image bearer, a charge device 2 that uniformly charges the surface of the photoconductive member 1, and an exposure device 3 that forms a latent image on the photoconductive member 1 carrying the charge by emitting a laser light thereto.

Also included are a developing device 4 that visualizes the latent image on the photoconductive member 1, a transfer device (e.g. a transfer roller) 5 that transfers the toner image visualized on the photoconductive member 1 and conveyed by the transfer belt 6, and a cleaning device 7 that clears toner remaining on the photoconductive member after the transfer process. Although the image formation section is only one in FIG. 32, plural image formation sections can be employed in tandem.

The exposure device includes a light source 3*a* having a semiconductor laser, a coupling lens, and an aperture and the like. Also included are a deflection device (a polygon mirror or the like) 3*b* that deflects a laser light transmitted from each of light sources, a scanning use lens 3*c*, and a light path folding back use mirror 3*d*. Thus, the exposure device deflects the laser light from the light sources 3*a* with the deflector 3*d*, applies exposure to the photoconductive member 1 in the image formation section 10 via the scanning use lens 3*c* and the mirror 3*d* thereby forming a latent image. The developing device then develops the latent image on the photoconductive member using toner.

The image forming apparatus also includes a sheet feeding and conveyance device that separates sheet like recording members S stacked on plural sheet feeding sections (i.e., a recording member stacking section) 8 one by one to the transfer belt 6 in synchronism with a toner image developed by the developing device 4 in the image formation section 10, and Plural fixing devices 71 and 12 that fix the toner image transferred onto the recording member S by the transfer device 5 such as a transfer roller when conveyed by the transfer belt 6.

A first fixing device 71 employing an electromagnetic heating system, and a second fixing device 12 employing a pressurizing system are arranged in parallel in this order on the recording member conveyance path 9. Further, an ejection roller 13 and an ejection tray 14 (or a post-processing device) are arranged downstream of the pressure-applying device 12.

In the image forming apparatus of FIG. 32, the latent image formed on the photoconductive member 1 by the exposure device 3 is visualized into a toner image by the developing device 4. In synchronism with the above, a recording member S stacked on the sheet feeding section 8 is separated one by one by the sheet feeding roller 8*a* and is launched into the transfer belt 6 on the conveyance path 9. The photoconductive member 1 pressure contacts the transfer belt 6 while being pressure contacted by the transfer device 5 to transfer the toner image onto the recording member S.

An exemplary transfer step and an electromagnetic heating section are specifically described with reference to FIG. 33. When an alternating current is flown through an exciting coil 71*b* of the electromagnetic heat induction device 71, a magnetic field H is created on the recording member conveyance path 9. Toner used for developing in this embodiment includes magnetic toner having magnetic substance 75*a* in resin 75*b*. Thus, an eddy current occurs in the magnetic substance 75*a* due to the magnetic field. Joule heat caused by a resistance of the magnetic substance 75*a* and the eddy current travels to the resin 75*b* and softens to toner 75, so that an attraction force of the toner 75 to the recording member S occurs. The electromagnetic induction-heating device 71 softens the toner at temperature of around a glass transition point. The recording members S is separated from the transfer belt 6 and is subjected to a pressurizing force of the pressure-applying device 12 maintaining a soft condition, so that the toner 75 is sufficiently firmly fixed onto the recording member S.

An exemplary relation between temperature of a resin and a plunger position in a Koka flow tester is described with reference to FIG. 38. The glass transition point (a softening point) is about 75 degree centigrade. Thus, when toner mainly including this resin is insufficiently soften at the temperature of 70 degree centigrade and intensely scraped after ejection, the toner is peeled off from a sheet. Whereas when the toner is softened at more than 72 degree centigrade, a sufficient fixing intensity can be obtained by means of a combination with the fixing device of the pressurizing system. Whereas a cold off set occurs when the conventional heat roller system executes fixing at temperature higher than the glass transition point by 5 degree centigrade (i.e., 80 degree centigrade), so that a fixing intensity is insufficient and heat is needed up to 85 to 92 degree centigrade.

Further, pressurizing fixation is only operable with pressurizing fixation use toner regardless of temperature. Even though a temperature slightly changes depending on a type of resin due to a difference of a glass transition point or a flow start point, the above-mentioned relation is substantially the same even when the other toner is used.

Figures 38, 39:
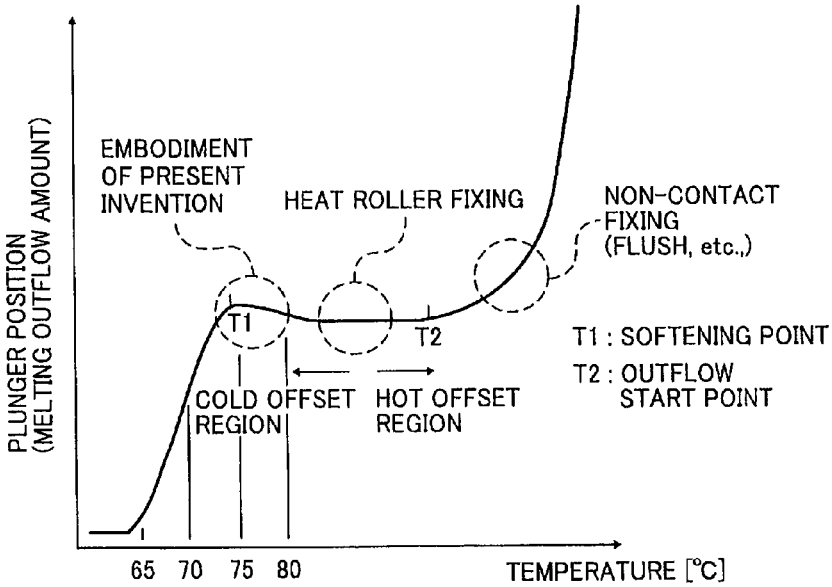
FIG. 38 illustrates a relation between temperature of resin of a flow tester and a position of a plunger.
FIG. 39 illustrates an exemplary capability of fixing at fixing temperatures both in a conventional fixing system of the fourth embodiment.

An exemplary availability of fixing at each temperature in a conventional system and that in this embodiment are illustrated in FIG. 39.

Figure 33:
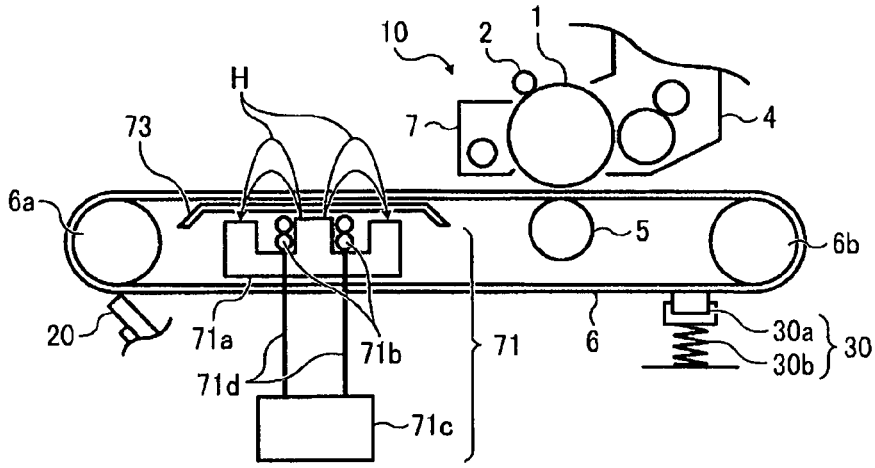
FIG. 33 is a perspective cross sectional view specifically illustrating the transfer belt, the electromagnetic induction heating device, and surroundings of the image forming apparatus FIG. 32.

In the image forming apparatus of this embodiment, to avoid toner from sticking in the vicinity of both side ends of the photoconductive member 1 and being firmly fixed onto a transfer belt 6, a cleaning blade 20 and a lubricant coating device 30 are arranged on the transfer belt 6 as shown in FIGS. 32 and 33. Specifically, a solid lubricant 30*a* such as zinc stearate preferably contacts a belt surface cleaned by the cleaning blade 20 being biased by a spring 30*b*.

Figure 34:
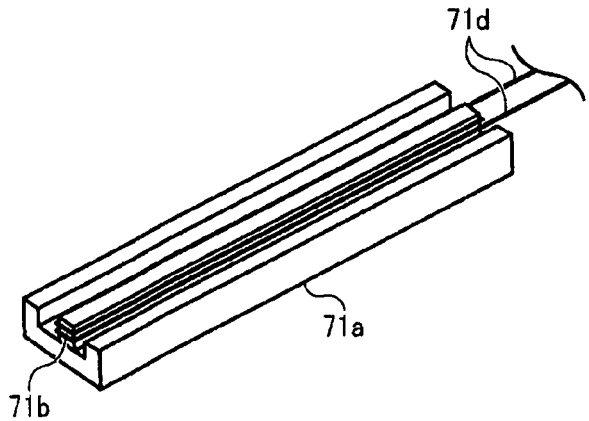
FIG. 34 is a perspective view illustrating the electromagnetic induction-heating device of FIG. 33.

Now, an exemplary principle with which toner 75 on the recording member S generates heat by means of the electromagnetic induction heating device 71 is more specifically described with reference to FIG. 33. As shown in FIGS. 33 and 34, the electromagnetic induction heating device 71 mainly includes a metal core 71*a* having a cross section of a letter E shape providing an opening toward the transfer belt 6, an exciting coil 71*b* wound around a central core section of the metal core 71*a*, and an exciting coil 71*c* that supplies an alternating current to the exciting coil 71*b*. A shield wall is provided at the periphery of the metal core 71*a* so as to block a (variable) magnetic flux from leaking off the opening. In such a situation, when the ac is supplied to the exciting coil 71*b*, the magnetic field H repeatedly appears and disappears at the periphery as shown by an arrow. In the electromagnetic induction-heating device 71, the exciting coil is arranged inside the transfer belt 6 at a position where the magnetic field H traverses the recording member S. Thus, the eddy current A occurs in the magnetic substance 75*a* so as to disturb a change of the magnetic field H when the variable magnetic field traverses the magnetic substance 75 in the toner. Owing to the resistance of the eddy current and the magnetic substance 75*a*, the Joule heat occurs and travels to soften the resin 75*b*. Thus, the toner 75 is firmly attracted to the recording member S.

After provisionally fixing the toner onto the recording member S with the electromagnetic induction heating device 71, the recording member S is converted to the pressure applying device 12 and is pinched and subjected to a pressurizing force between the upper and lower rollers 12*a* and 12*b*. As a result, the toner is sufficiently intensely fixed onto the recording member S when passing through the pressure-applying device 12.

The transfer belt 6 is a two-layer type that includes a sheet like substrate layer having high heat resistivity and a surface-releasing layer overlying the substrate layer. The substrate layer is not limited to, but is preferably made of a semiconductor material having the thickness of from 10 to 100 micrometer, preferably obtained by dispersing conductive material, such as carbon black, etc., to resin having a high heat resistivity, such as polyester, polyethylene terephthalate, polyether sulfone, polyether ketone, poly-sulfone, polyimide, polyimide amido, polyamide, etc. The purpose of dispersing the conductive material to the substrate layer is to apply an electric field and obtain a fine electrostatic transfer performance of transferring a toner image in the transfer process. The surface releasing layer preferably includes a coat layer having a high releasability having a thickness of from 0.1 top 30 micrometer, such as tetrafluoro-ethylene-perfluoro-alkyl-vinylether-copolymers, polytetrafluoro-ethylene-silicon-copolymers, etc.

A frequency of the alternating current applied to the exciting coil 71*b* preferably ranges from 10 to 500 kHz. When more than 10 kHz is used, an absorption efficiency to the magnetic substance 75*a* is improved. Thus, an exciting circuit 71*c* can be built with a cost reduced element up to 500 kHz. Further, since an audible range is exceeded when 20 kHz is used, noise possibly created at the time of power supply disappears. When less than 200 kHz is used, loss in the exciting circuit 71*c* is small while noises for the periphery can be reduced.

Figure 35:
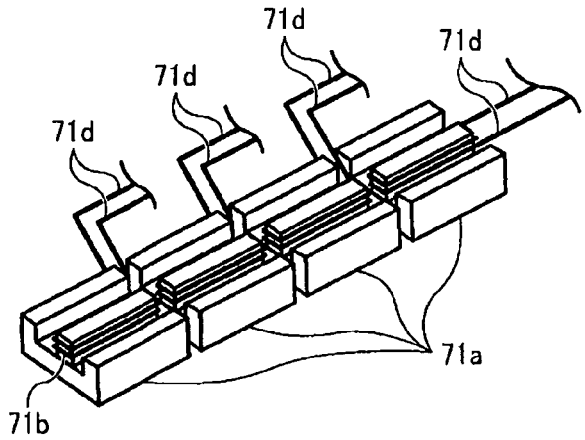
FIG. 35 is another perspective view illustrating the electromagnetic induction-heating device of FIG. 33.
Figure 36:
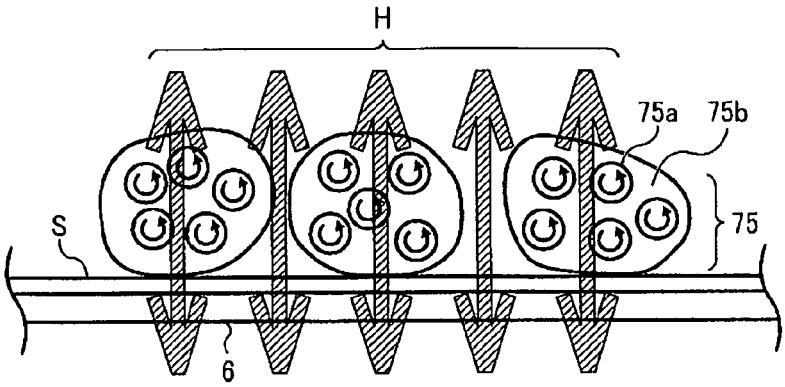
FIG. 36 is a schematic cross sectional view illustrating an exemplary condition of an eddy current generated in a heat-applying member (a magnetic member) included in toner on a recordation member conveyed by a transfer belt of FIG. 36.

A modification of this embodiment is now described with reference to FIG. 35. As shown, the metal core 71*a* and the exciting coil 71*b* are divided into plural pieces in a direction perpendicular to a traveling direction of the transfer belt 6 including respective exciting circuits 71*c*. Then, the electromagnetic induction-heating device 71 (the exciting coil 71*b*) is supplied with power where the recording member S passes, while not supplied to the other sections in accordance with a width of the recording member S conveyed. A number of division times and a length of the electromagnetic induction-heating device 71 are appropriately determined in accordance with the width of the recording member S. To detect the width of the recording member S, a dial, not shown, is provided in the sheet feeding section 8 so that a size of the recording member S is manually designated. Otherwise, a detector, such as a reflection type photo sensor, etc., not shown, is arranged on the recording member conveyance path 9 to automatically detect the width.

Figure 40:
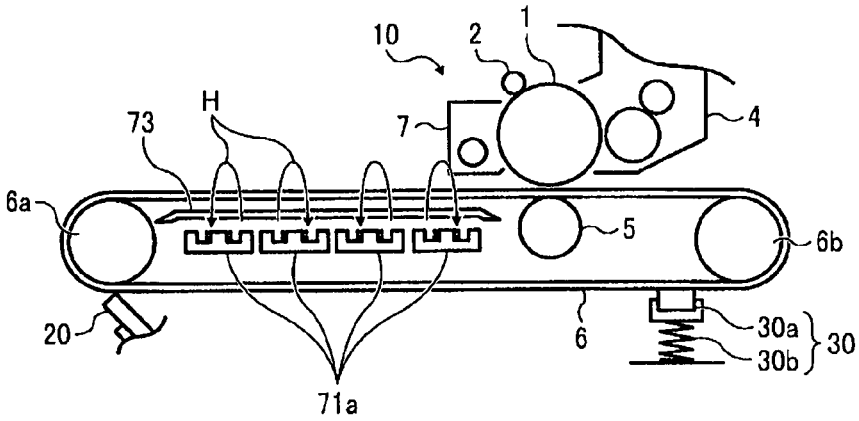
FIG. 40 is a cross sectional view schematically illustrating another exemplary image forming apparatus of the fourth embodiment according to the present invention.

Another modification of this embodiment is described with reference to FIG. 40. As shown, plural electromagnetic induction heating devices 71 (e.g. magnetic cores 71*a* winding an exciting coil 71*b*) can be arranged in a conveyance direction of the recording member S. Thus, such a device can be used in a situation where a preheat time period decreases in accordance with high-speed tendency of the image forming apparatus. Further, even when a sheet feeding speed is changeable in the image forming apparatus, the electromagnetic induction-heating device 71 supplied with power can be switched to another in accordance with a sheet feeding speed. Whereas when the sheet feeding speed is more than the prescribed level, all of the electromagnetic induction heating devices 71 are supplied with power and precisely increase temperature of the toner on the recording member S up to a glass transition point so that the toner is softened and molten.

Not only two steps, but also plural steps can be employed to switch the electromagnetic induction heating devices 71 supplied with power in accordance with the line speed. For example, when the line speed is less than 300 mm/sec, only one electromagnetic induction-heating device 71 is supplied with power, while all of the electromagnetic induction heating devices 71 is supplied with power when the line speed exceeds 300 mm/sec. Specifically, according to this configuration, the toner 75 on the recording member S can be precisely softened and molten to a prescribed target level in comparison with the conventional fixing system, so that waste of power can be suppressed. Further, when the induction heating system of this embodiment is used, since the magnetic member 75*a* included in the toner 75 generates heat, only a calorie capable of softening and melting toner on the recording member S is needed, thereby further saving the power.

Further, the toner can also be provisionally heated and softened on an intermediate transfer member, but is more preferably done by means of a direct transfer process. Because, when the toner is provisionally heated and softened on an intermediate transfer member, the toner firmly sticks to the intermediate transfer member and is possibly hardly removed from the intermediate transfer member at the time of sheet jamming or the like. Whereas, such a problem can be prevented by the direct transfer process. Thus, when the electromagnetic induction heating device 71 of this embodiment is applied to the intermediate transfer system, the electromagnetic induction heating device 71 and the pressure applying device 12 are preferably arranged downstream of the second transfer device 27 on the recording member conveyance path 9 as in the first to third embodiments.

Figure 37:
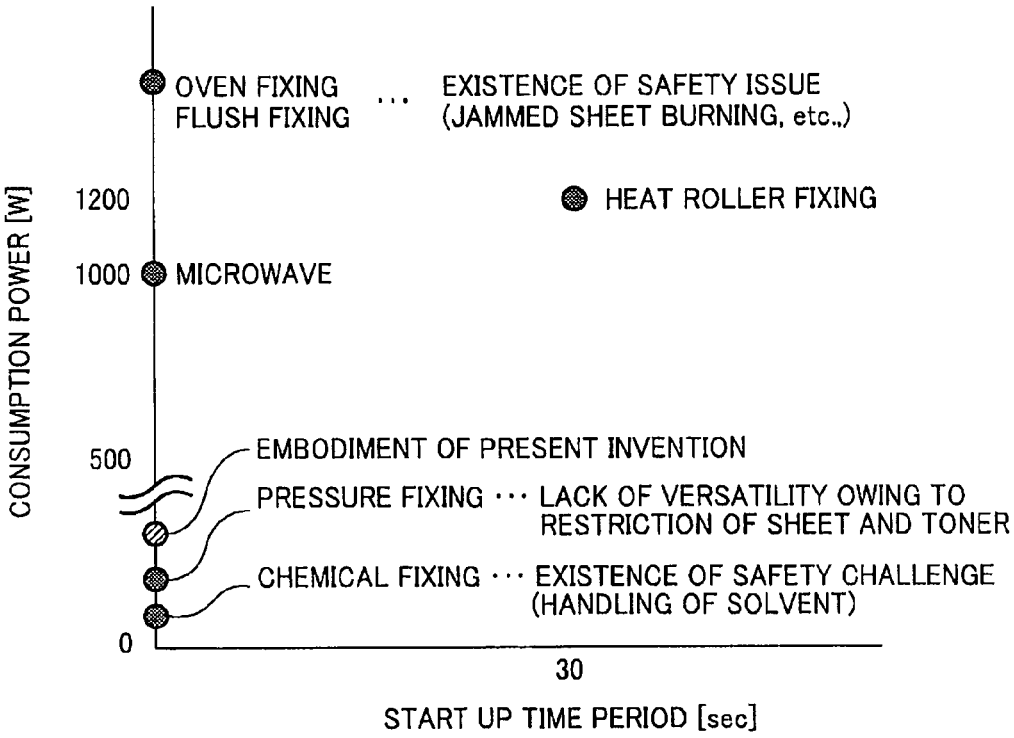
FIG. 37 illustrates a relation between a start up time period and a consumption power in various conventional fixing systems and the fourth embodiment.

In the above-mentioned various embodiments, since the heat applying device 71 and the pressure applying device 12 are arranged in parallel, heat energy can be more saved than an image forming apparatus employing only a heat applying device. Further, since the heat applying device 71 employs the electromagnetic heat induction system and accordingly only heats the toner 75 excluding the recording member S heat for the recording member can be omitted so that energy can be saved. Further, a startup time can be decreased. An exemplary relation between a start up time and power consumption in various conventional fixing systems and that in this embodiment are described in FIG. 37.

Since the recording member S is not heated in the image forming apparatus of this embodiment, a problem, such as a sheet curl caused by heat traveling to the recording member (paper), a transfer malfunction caused by decrease of water content in the paper at the time of first surface printing in a duplex printing mode, etc., can be prevented. Further, since the both of the transfer and heat applying processes are executed on the common conveyance belt (the transfer belt 6), image deterioration, such as toner scattering, etc., likely occurring when the recording member S is separated from the conveyance belt can be suppressed.

Further, since the metal core (magnetic core) 71*a* of the electromagnetic induction heating device 71 is divided into more than two pieces in the direction perpendicular to the belt conveyance direction in the above-mentioned image forming apparatus, and the current is selectively flown in accordance with a width of the recording member conveyed while suppressing power consumption at the non sheet feeding section, the energy can further be saved.

Further, since each of the metal cores can be shortened, a shape and a size can more precisely be molded.

Further, in this embodiment, as in the first and second embodiments, a separation and contact mechanism and a gap adjusting mechanism are provided to the pair of pressure applying rollers 12*a* and 12*b* of the pressure-applying device 12. For example, as a mechanism capable of simply and precisely adjusting the gap between the pair of pressure applying rollers is provided as in the second embodiment described with reference to FIGS. 18 and 19. Specifically, a similar compression spring 33, a cam 41, and a motor or the like are provided. Thus, the gap G can be maintained to be a prescribed width in accordance with a rotational position of the cam secured to the shaft 42 of the motor, not shown. For example, the gap G of the pair of pressure applying rollers is smaller than the thickness of the recording member S, and thus, the toner softened by the heat-applying device 11 receives a pressurizing force and is fixed on to the recording member S.

Further, In accordance with information inputted by an operator through an operation panel, not shown, of an image forming apparatus, the cam 41 is rotated by a driving force of a motor, not shown, either to a position of FIG. 18 so that the gap G of the pair of pressure applying rollers decreases or that of FIG. 19 so that the gap G thereof increases. By always setting the gap G to be slightly smaller than the thickness of the recording member S, the same pressurizing force is applied thereto regardless of the thickness of the recording member S. The cam 41 can be stopped when rotated with a prescribed angle, so that the gap G is changed stepwise.

Instead of the combination of the motor and the cam as used in this embodiment, the other method can be employed to change the gap G between the pair of pressure applying rollers.

Also in the image forming apparatus of this embodiment, since the gap of the pair of pressure applying rollers of the pressure-applying device 12 can be changed in accordance with the thickness of the recording member S as in the second embodiment, a constant pressurizing force can be applied to the recording member. Thus, a problem of insufficient fixation due to an insufficient pressurizing force and that of wrinkle of the recording member or the like caused by an excessive pressurizing force can be suppressed. Further, the gap of the pair of pressure applying rollers can be changed to be a prescribed level in response to the selection of the sheet-feeding device that feeds the recording member S. By designating correspondence between the type or thickness of the recording member S stacked on the sheet-feeding device and the gap beforehand, the optimum gap can be automatically determined in accordance with the respective recording members. Further, as in the second embodiment, a detecting device for detecting a thickness of the recording member S can be provided, and the gap G can automatically be changed to the optimum value in accordance with the thickness. Further, by providing a control device that determines if a print on a recording member is either monochrome or multi color, and the optimum gap is automatically obtained in accordance with a difference of the print. Further, by providing a control device capable of determining if the image area rate (i.e., a printing rate) of the recording member S exceeds a prescribed level, the gap can automatically be changed to the optimized level in accordance with the image area rate.

Now, a fifth embodiment is described with reference to FIG. 41, in which a heat applying device and a pressure applying device are arranged in parallel as a fixing device as in the first to fourth embodiments. However, the heat-applying device employs a laser light emission system. The transfer and laser light emission steps are provided on the common conveyance belt. Thus, toner transfer and laser light emission are executed onto the recording member on condition that the recording member tightly contacts and is fed at the same traveling speed as the conveyance belt. Thus, displacement of the position of the toner image transferred onto the recording member from where the laser is emitted is decreased. Thus, the laser is not needlessly emitted, and accordingly energy can be saved and a laser light generation device can enjoy long life. Further, the toner image is transferred onto the recording member on the conveyance belt, so that a problem such as deterioration of an image caused by scattering of non-fixed toner due to an operation of electrostaticity when the recording member contacts the conveyance belt can be avoided. Also in this embodiment, beside the laser light emission device, a fixing device of a pressure-applying device employing a pressure applying system is provided so as to obtain a sufficient fixing performance.

Specifically, as shown there, the image forming apparatus includes a monochrome machine having the same configuration as the image forming apparatus of the fourth embodiment described with reference to FIG. 34.

As shown, only one image formation section (an image formation device) 10 is provided along the conveyance belt that carries and conveys a sheet like recording member S to the transfer section.

The configuration of the image formation section 10 is as same as that of FIG. 32.

Figure 43:
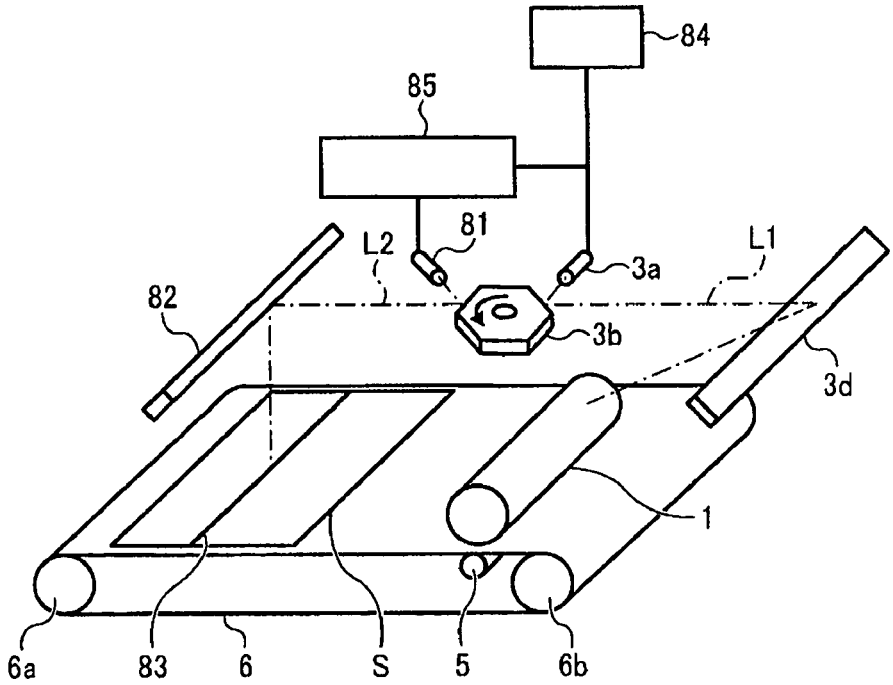
FIG. 43 is a perspective view schematically illustrating an exemplary relation between a laser light-emitting device used for the heat applying device and an optical path provided in the image forming apparatus of FIG. 41.

However, a laser light emission device that emits a laser light to toner on the recording member S carried on the conveyance belt is arranged downstream of the transfer device 5 as shown in FIG. 43 as a first fixing device.

Specifically, the laser light emission device and the exposure device (a laser light generation device for image formation use) 3 commonly uses a diffusing device (e.g. a polygon mirror) for laser light scanning use and exposure use.

Figure 41:
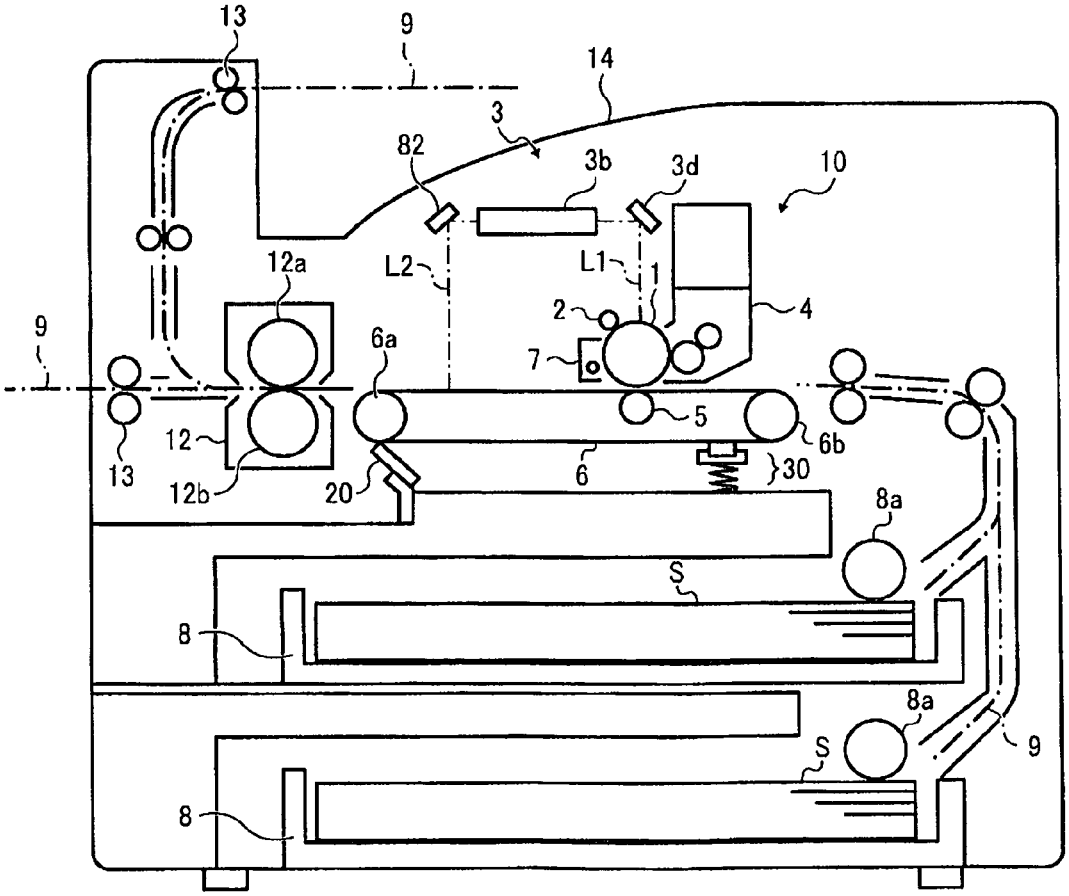
FIG. 41 is a cross sectional view schematically illustrating the other exemplary image forming apparatus of the fifth and sixth embodiments according to the present invention.
Figure 42:
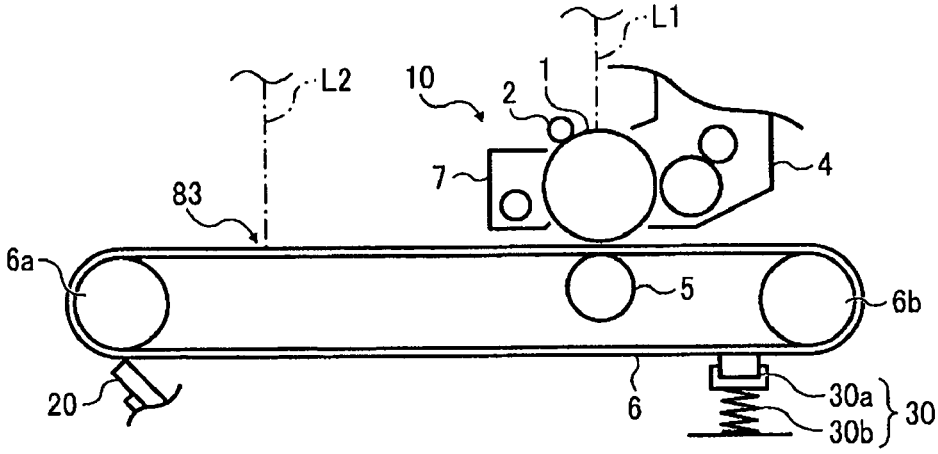
FIG. 42 is a schematic cross sectional view illustrating the transfer belt and its surroundings in the image forming apparatus of FIG. 41.

As shown in FIGS. 41 to 43, in the image forming apparatus of this embodiment, a latent image is formed on the photoconductive member 1 using a image formation use laser light L1 emitted from a light souse device (a laser light generation device) included in the exposure device 3, and is visualized by the developing device 4 as a toner image. In synchronism therewith, the recording member S stacked on the sheet feeding section (sheet feeding tray) 8 is separated and fed one by one by a sheet feeding roller 8*a* and is launched onto the transfer belt 6 arranged on the recording member conveyance path 9. The photoconductive member 1 receives a pressurizing force from the transfer roller 5 and pressure contacts the transfer belt 6, so that the toner image on the photoconductive member 1 is transferred onto the recording member S. A fixing use laser light 12 emitted by the fixing use laser light generation device 81 is diffused by the polygon mirror 3*b* for scanning and is reflected by a mirror 82, so that the fixing use laser light reaches a fixing point 83 on the fixing belt 6.

Figure 44:
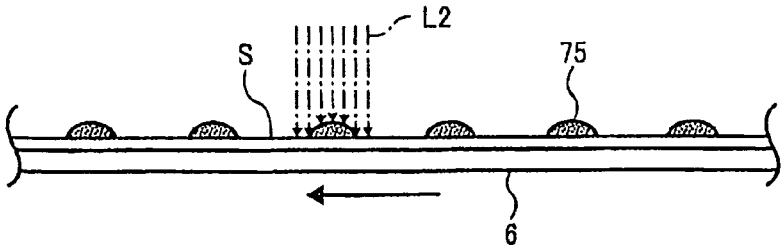
FIG. 44 is a perspective view schematically illustrating an exemplary condition of a fixing use laser light emitted to toner on a recording member conveyed by the transfer belt.
Figure 45:
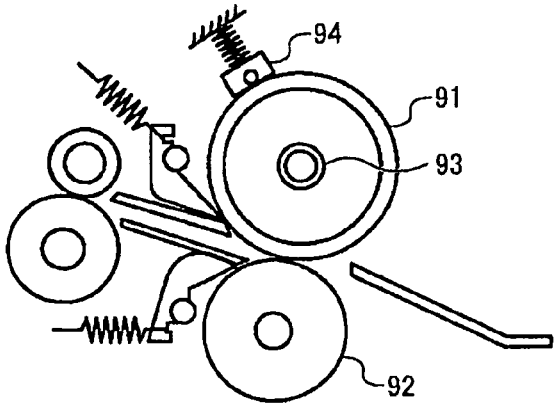
FIG. 45 CONVENTIONAL ART
FIG. 45 is a schematic cross sectional view illustrating a conventional heat roller type-fixing device.
Figure 46:
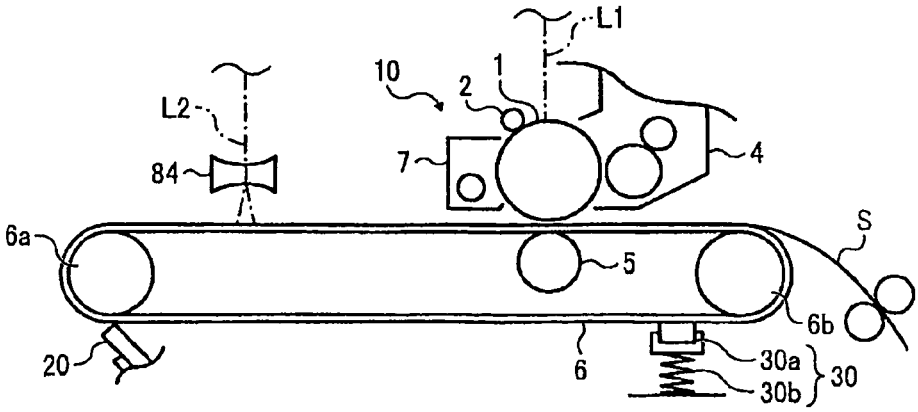
FIG. 46 is a schematic cross sectional view illustrating an exemplary modification of the sixth embodiment having a concave lens on an optical path for fixing use laser light in the image forming apparatus of FIG. 41.

When the recording member S with toner image arrives at the fixing point 83 as the transfer belt 6 travels, the fixing use laser light 12 softens the toner 75, so that an attraction force is created between the recording member S and the toner 75 as shown in FIG. 44. The fixing use laser light 12 is controlled by a control section 84 and a memory 85 only to be emitted to the toner image existing section avoiding the non-image section. In order to cover a variant of traveling speed of the transfer belt 6 or the like, the fixing use laser light 12 can be emitted to an area slightly larger than the toner existing region.

Further, a pressure applying device 12 having the same configuration as in the first to fourth embodiments is arranged downstream of the transfer belt 6, so that the recording member S separated from the transfer belt 6 can receive a pressurizing force from the pressure applying device 12. Thus, the toner softened by the laser light emission can further firmly be fixed thereonto. Further, as in the first and second embodiments, a contact and separation mechanism and a gap adjustment mechanism or the like are provided for the pair of pressure applying rollers 12*a* and 12*b* of the pressure applying device 12 in the image forming apparatus of this embodiment. For example, the gap adjustment mechanism including the compression spring 33, the cam 41, and the motor or the like as illustrated in FIGS. 18 and 19*a* rearranged as a mechanism for more precisely adjusting the gap between the pair of pressure applying rollers as described in the second embodiment. Specifically, in accordance with the rotational position of the cam 41 secured to the shaft 42 of a motor, not shown, the gap G can be maintained at a prescribed level. For example, the gap G is smaller than the thickness of the recording member S, and the toner softened by the heat-applying device 11 is fixed receiving the pressurizing force.

Further, in accordance with information inputted by an operator through an operation panel, not shown, of an image forming apparatus, the cam 41 is rotated by a driving force of a motor, not shown, either to a position of FIG. 18 so that the gap G decreases or that of FIG. 19 so that the gap G increases. By setting the gap G to be slightly smaller than the thickness of the recording member S, the same pressurizing force is applied thereto regardless of the thickness of the recording member S. The cam 41 can be stopped when rotated with a prescribed angle, so that the gap G is changed stepwise.

Instead of the combination of the motor and the cam used in this embodiment, the other method can be employed to change the gap G.

Also in the image forming apparatus of this embodiment, since the gap of the pair of pressure applying rollers of the pressure-applying device 12 can be changed in accordance with the thickness of the recording member S as in the second embodiment, a constant pressurizing force can be applied to the recording member. Thus, a problem of insufficient fixation due to an insufficient pressurizing force and that of wrinkle or the like of the recording member caused by an excessive pressurizing force can be suppressed. Further, the gap of the pair of pressure applying rollers is preferably changed to be a prescribed level linking with the selection of the sheet-feeding device 8 feeding the recording member S. By designating correspondence between the type or thickness of the recording member S stacked on the sheet-feeding device and the gap beforehand, the optimum gap can be automatically determined in accordance with the respective recording members. Further, as in the second embodiment, a detecting device for detecting a thickness of the recording member S can be provided, and the gap G can automatically be changed to the optimum value in accordance with the thickness. Further, by providing a control device that determines if a print on a recording member is either monochrome or multi color, the optimum gap can be automatically obtained in accordance with color of the print. Further, by providing a control device capable of determining if the image area rate (i.e., a printing rate) of the recording member S exceeds a prescribed level, the gap can automatically be changed to the optimized level in accordance with the image area rate.

According to this embodiment, since the toner transfer and the laser light fixing are executed on the common conveyance belt, displacement of the position of the toner image from where the laser is emitted is small. Thus, since the laser light does not or slightly need to be emitted back and forth of the toner image in comparison with the conventional device, energy can be saved while the laser light generation device can enjoy long life. Further, since both of the heat applying device 11 (laser light emission devices 81, 82, and 3*b* or the like) employing the laser light emission system and the pressure applying device 12 are arranged in parallel and a pressure is applied to the toner to generate heat and softened by the laser light, a sufficient fixing performance can be obtained. Further, the pressure-applying device employs a pressurizing system, power is not needed for a heater or the like, so that energy can be save. Further, since the pressure-applying device includes the configuration as described in the second embodiment, the same advantage can be obtained.

Now, a sixth embodiment is described, in which the heat applying device and pressure applying device are arranged in parallel as a fixing device as in the first to fourth embodiments. However, in this embodiment, as in the fifth embodiment, a pressure-applying device employs a laser light emission system. The transfer and laser light emission steps are provided on the common conveyance belt. Thus, toner image transfer and laser light emission are executed onto the recording member on condition that the recording member tightly contacts and is fed at the same traveling speed as the conveyance belt. Thus, displacement of the position of the toner image transferred onto the recording member from where the laser is emitted is decreased. Thus, the laser is not needlessly emitted, and accordingly energy can be saved and a laser light generation device can have long life. Further, the toner image is transferred onto the recording member on the conveyance belt, so that a problem such as deterioration of an image caused by scattering of non-fixed toner due to an operation of electrostaticity when the recording member contacts the conveyance belt can be avoided. Also in this embodiment, beside the laser light emission device, a fixing device of a pressure-applying device employing a pressure applying system is provided so as to obtain a sufficient fixing performance.

Further, a type of toner softened and fixed by the laser light emission is not specified in the fifth embodiment. However, since heat generation efficiency decreases when non-magnetic toner excluding metal is employed in comparison with magnetic toner. Then, the magnetic toner is used so that energy of the laser light emitted can efficiently be converted into heat so as to further save energy. Further, in addition to the configuration of FIG. 5, a spot diameter-changing device is provided to change a spot diameter of a laser light while downsizing the image forming apparatus.

The fundamental configuration of the image forming apparatus of this embodiment is as the same as that described with reference to FIGS. 41 to 43. Specifically, a latent image is formed on the photoconductive member 1 by an image formation use laser light L1 emitted from the light source (a laser light emission device) included in the exposure device 3. The latent image is visualized to be a toner image by the developing device 4. In synchronism with the above, a recording member S stacked on the sheet feeding section 8 is separated one by one by the sheet feeding roller 8*a* and is launched into the transfer belt 6 on the conveyance path 9. The photoconductive member 1 receives a pressurizing force of the transfer roller 5 and pressure contacts the transfer belt 6, so that the toner image thereon is transferred onto the recording member S. The fixing use laser light 12 emitted by the fixing use laser light generation device 81 is diffused by the polygon mirror 3*b* for scanning and is reflected by the mirror, and is further emitted to the fixing point 83 on the transfer belt 6. When the recording member S with toner image arrives at the fixing point 83 as the transfer belt 6 travels, the spotlight 85 of the fixing use laser light 12 is scanned in a direction perpendicular to the recording member conveyance direction, so that the fixing use laser light 12 softens the toner 75, and that an attraction force is created between the recording member S and the toner 75 as shown in FIG. 44. The fixing use laser light 12 is controlled by a control section 84 and a memory 85 only to be emitted to the toner existing section avoiding the non-image section. In order to cover a variant of traveling speed of the transfer belt 6 or the like, the fixing use laser light 12 can be emitted to an area slightly larger than the toner existing region. As far as the toner 75 is magnetic, one or more component toner can be used.

Further, similar to the first and fourth embodiments, a pressure-applying device 12 is provided downstream of the transfer belt 6, so that the recording member S separated from the transfer belt 6 can receive a pressurizing force from the pressure-applying device 12. Thus, the toner softened by the laser light emission can further firmly be fixed thereonto. Further, as in the first and second embodiments, a contact and separation mechanism and a gap adjustment mechanism or the like are provided for the pair of pressure applying rollers 12*a* and 12*b* of the pressure applying device 12 in the image forming apparatus of this embodiment. For example, the gap adjustment mechanism including the compression spring 33, the cam 41, and the motor or the like as illustrated in FIGS. 18 and 19 are arranged as a mechanism to simply and more precisely adjust the gap between the pair of pressure applying rollers as described in the second embodiment. Specifically, in accordance with the rotational position of the cam 41 secured to the shaft 42 of a motor, not shown, the gap G can be maintained at a prescribed level. For example, the gap G is smaller than the thickness of the recording member S, and the toner softened by the heat-applying device 11 is fixed receiving the pressurizing force. Specific configuration and operation of the mechanisms are the same as mentioned heretofore.

In the image forming apparatus of this embodiment, as shown in FIG. 43, a laser for wiring use by the exposure device 3 and that for softening and melting the toner on the recording member S are emitted to the single polygon mirror 3*b*. In such a situation, the latter laser has a larger diameter than the former laser. Because, when the laser having the same spot diameter is used in the latter, the heat is readily absorbed by the recording member S at an image area edge of the outside of the image area, so that the toner 75 is hardly uniformly softened and melted up to the image area edge.

Accordingly, when a laser having a spot diameter possibly emitted in the vicinity of the image area is used, so that the recording member S can be heated at the outside of the image area in the vicinity of the edge thereof, and accordingly, the heat is not provably absorbed by the recording member S at the image area edge. As a result, the toner can be uniformly softened and melted.

Further, when a laser having the same spot diameter is used by the laser light emission device as the light source device 3*a* and 81, the spot diameter is instead preferably expanded before being emitted to the toner 75 on the recording member S. For example, by arranging a concave lens 84 serving as a diffusion member diffusing the fixing use laser light 12 reflected by the polygon mirror 3*b* before arriving at the toner 75 on the recording member S.

The spot diameter can be expanded right before the recording member S.

Figure 47:
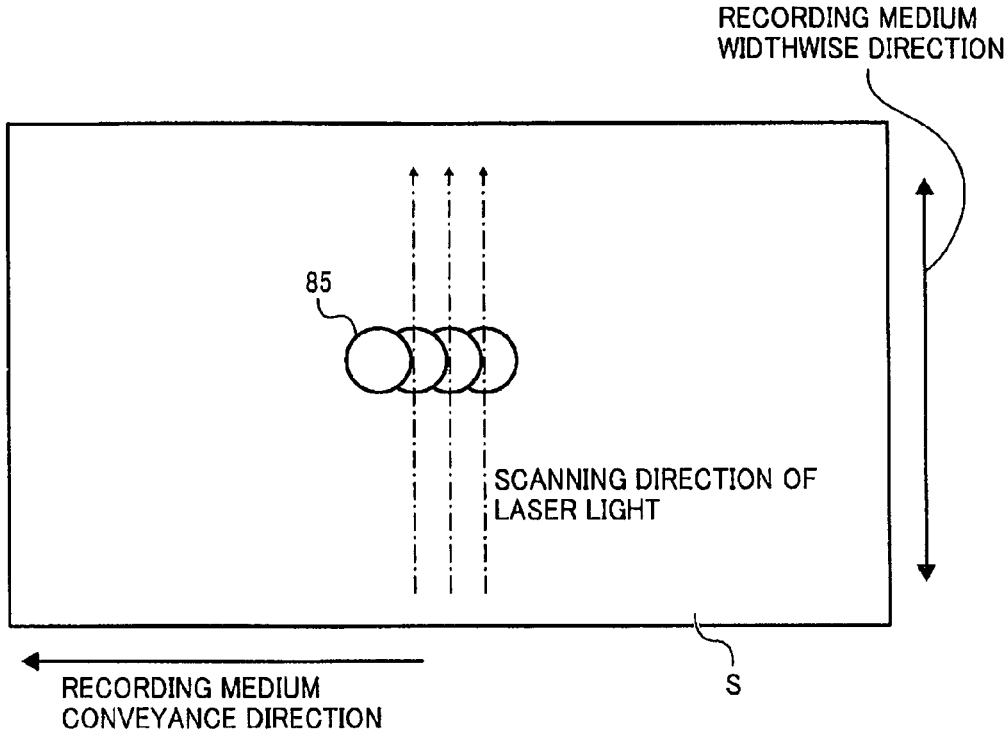
FIG. 47 illustrates an exemplary relation between a conveyance direction of a recording member and a scanning direction of the laser light.

A curvature shape of the concave lens 84 as a laser light emission device and a distance to the transfer belt 6 are appropriately determined in accordance with the spot of the emission laser light L2. Further, even not shown, if a moving mechanism that moves the concave lens 84 in a direction of an optical axis and an insertion and releasing mechanism that inserts and releases the concave lens from the light path are provided, a spot diameter of the laser light 12 can be variably adjusted. With this configuration, when a traveling speed of the transfer belt 6 varies due to slip or the like, the spot diameter of the laser light 12 is variably adjusted, so that toner 75 is precisely softened and melted and a fixing malfunction can be prevented. Specifically, when a spot light 85 of a laser is scanned in the widthwise direction of the recording member S and the diameter thereof is expanded as show in FIG. 47, neighboring spots of the lasers overlap with each other per scanning. Thus, even if the traveling speed of the transfer belt 6 varies, the laser is precisely emitted to the toner on the recording member S, so that possibility of creating the fixing malfunction due to omission of the laser can be decreased.

In the above, the concave lens 84 is preferably arranged in the vicinity of the transfer section (transfer device 5) where toner is transferred onto the recording member S.

As a result, a length of the transfer belt 6 can be short thereby downsizing the configuration.

Figure 48:
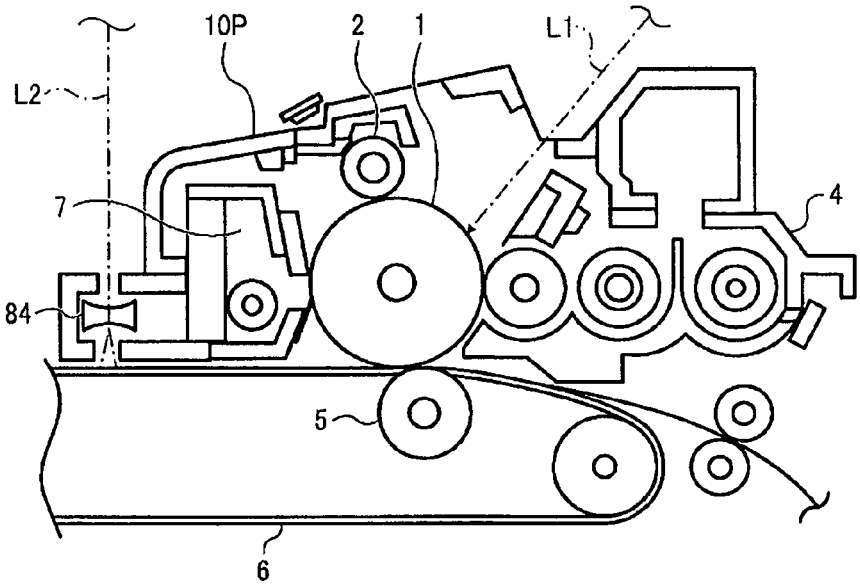
FIG. 48 is a schematic cross sectional view illustrating another exemplary modification of the sixth embodiment having a process cartridge in an image formation section, in which a concave lens container section and an optical path for a fixing use laser light are integrally arranged.

Further, the concave lens 84 can be included in a process cartridge together with a cleaning device 7, such as a cleaning brush, a cleaning blade, etc., that removes toner remaining on the photoconductive member 1 as shown in FIG. 48, in which the concave lens is arranged in the vicinity of the cleaning device 7.

As shown, the process cartridge 10P includes an image formation section 10, in which a photoconductive member 1, a charge device 2, a developing device 4, a cleaning device 7, and a light are included.

Also included are light path for a fixing use laser light 12 and an installation section for installing the concave lens 84 arranged in the vicinity of the cleaning device 7 of the process cartridge 10P.

Thus, a system for softening toner in the vicinity of the transfer section can be realized while enabling easy replacement of the concave lens 84 with a new necessitated due to its damage and deterioration.

Figure 49:
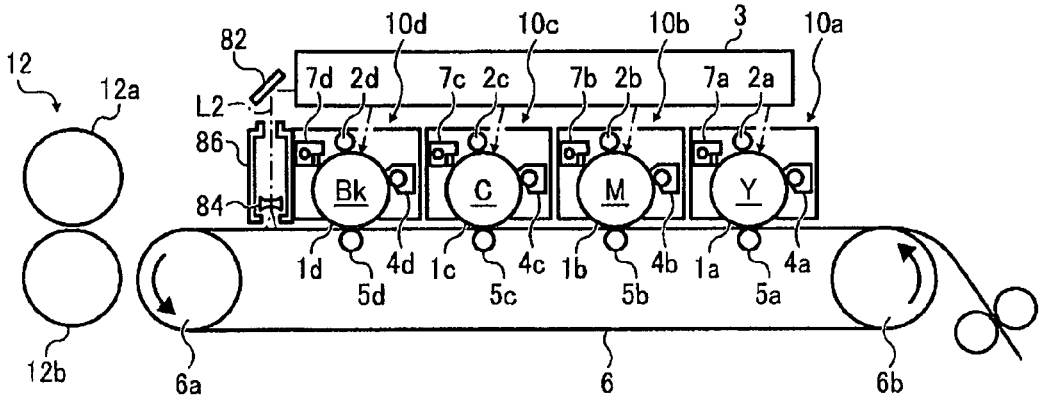
FIG. 49 is a schematic cross sectional view illustrating still another exemplary modification of the sixth embodiment including a color image forming apparatus having plural image formation sections arranged in parallel.

A modification of the image forming apparatus of this embodiment is now described with reference to FIG. 49. A tandem system color image forming apparatus includes a fixing device that includes a heat-applying device employing a laser light emission system (a laser light emission device) and a pressure-applying device 12. In the image forming apparatus, plural image formation sections 10*a* to 10*d* are arranged from upstream of a recording member convey direction in this order along a conveyance belt (a transfer belt) 6 that caries and conveys a recording member to a transfer position.

The respective image formation sections are formed as process cartridges to include drum state photoconductive members 1*a* to 1*d*, charge devices 2*a* to 2*d*, developing devices 4*a* to 4*d*, and cleaning devices 7*a* to 7*d*.

As shown, a black use process cartridge 10*d* arranged downstream on the transfer belt 6 includes a light path is arranged in the black use process cartridge at a position downstream of the recording medium conveyance direction for the fixing use laser light 12 to pass (i.e., on the left side of the process cartridge neighboring to the cleaning device 7*d*). The light path on the other hand serves as an installation section 86 to install a concave lens 84 serving as a diffusion lens 84 for diffusing the laser light.

Figure 50:
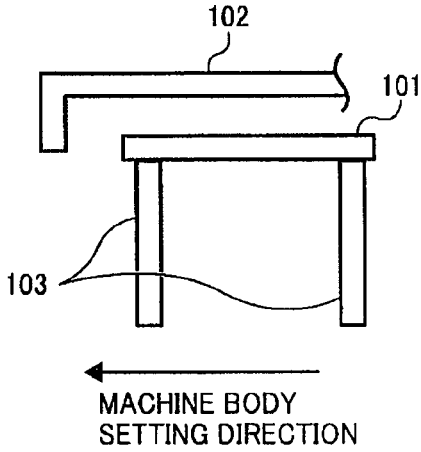
FIG. 50 illustrates an exemplary modification of the image forming apparatus of FIG. 49 including an exemplary shielding member arranged at an opening serving both as an optical path for a fixing use laser light and a concave lens containing section.
Figure 51:
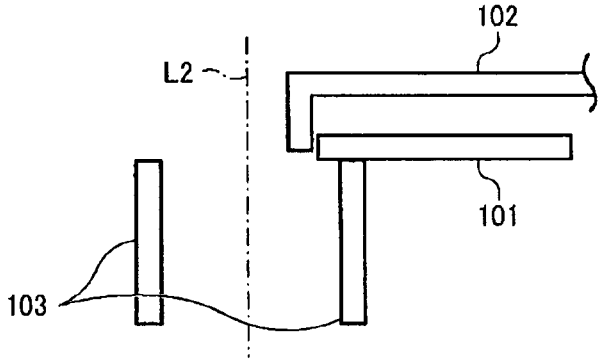
FIG. 51 illustrates an exemplary condition of the shielding member of FIG. 50 when being open.

Further, a light path guide 103 is provided at a light entrance side opening formed on the light path installation section 86. A shield member 101 is provided as shown in FIGS. 50 and 51 to horizontally slide and shield the fixing use laser light 12. Thus, the shield member 101 is openable. Then, as shown in FIG. 51, when the process cartridge 10*d* is attached to the image forming apparatus body, the shield member 101 is open by a protrusion arranged on the body side so as to allow the fixing use laser light 12 to pass through the light path installation section 86. When the process cartridge 10*d* is detached from the body for the purpose of maintenance or the like, the shield member 101 is moved by a spring, not shown, on the light path to close the light path guide 103. Specifically, when the process cartridge 10*d* is detached from the body, the light path installation section 86 is closed by the shield member 101 to protect by preventing dust from entering thereto. When the process cartridge 10*d* is set to the image forming apparatus body, the protrusion 102 engages with and makes the shield member sliding to open the light path.

Thus, when the tandem color image forming apparatus employs the heat-applying device of the laser light emission system and the pressure-applying device 12 as a fixing device, the apparatus can be downsized while providing a system capable of softening toner in the vicinity of the transfer section. Further, the lens can be protected and readily replaced with a new when damaged or deteriorated.

As mentioned heretofore, since the toner is magnetic and efficiently generates heat a lot when receiving a laser light, the toner can be efficiently softened in comparison with nonmagnetic toner. Further, toner image transfer and provisional fixing thereof onto the recording member S are executed on the common conveyance belt 6, the toner image only slightly displaces from a light emission position. Thus, laser light emission does not at all or slightly needs to be emitted back and forth of the toner image supposing displacement in comparison with a conventional device, so that energy can be saved and that a laser light emission device can enjoy a long life. Since the laser light emission device and the pressure-applying device are arranged in parallel, sufficient fixing performance can be obtained by heating with the laser light and applying pressure to the toner. Further, since the pressure-applying device employs a pressurizing system, power is not needed unlike a heating system only employing heating device, so that energy can be saved. Further, the pressure-applying device 12 employs the above-mentioned configuration; the same advantage can be obtained.

Obviously, numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus, comprising:

a toner image formation device configured to form a non fixed toner image on a recording member;

a first fixing device configured to apply heat to the non fixed toner image; and a second fixing device arranged downstream of the first fixing device and configured to apply pressure and fix the non-fixed toner image onto the recording member, wherein the first fixing device includes:

a conveyance belt including a pair of rollers configured to convey the recording member, and a laser light generation device configured to generate a laser light;

a laser light-scanning device configured to defuse and scan the laser light emitted from the laser light generation device to the non fixed toner image electrostatically attracted onto the conveyance belt;

wherein the laser light scanning device is used as an exposure device for forming a latent image on an image bearer, a beam spot diameter-changing device configured to change a beam spot diameter of a laser beam, a process cartridge configured to install at least the image bearer, a light path guide for guiding the laser light to the image bearer, and a light path through which the laser light for fixation passes thereto radiates light to the non fixed toner image on the recording medium in the process cartridge, wherein the second fixing device includes a pair of opposing rollers configured to pinch and pressurize the recording member.

2. An image forming apparatus, comprising:

a toner image formation device configured to form a non fixed toner image on a recording member;

a first fixing device configured to apply heat to the non fixed toner image; and a second fixing device arranged downstream of the first fixing device and configured to apply pressure and fix the non-fixed toner image onto the recording member, wherein said first fixing device includes:

a conveyance belt configured to convey the non fixed toner image;

a laser light generation device configured to generate a laser light;

a laser light scanning device configured to defuse and scan the laser light emitted from the laser light generation device to the non fixed toner image electrostatically attracted onto the conveyance belt;

wherein the laser light scanning device is used as an exposure device for forming a latent image on an image bearer, a beam spot diameter-changing device configured to change a beam spot diameter of a laser beam, a process cartridge configured to install at least the image bearer, a light path guide for guiding the laser light to the image bearer, and a light path through which the laser light for fixation passes thereto radiates light to the non fixed toner image on the recording medium in the process cartridge.

3. The image forming apparatus as claimed in claim 1, wherein said pair of pressure applying rollers is separated with a prescribed gap at a passage of the recording member.

4. The image forming apparatus as claimed in claim 3, further comprising a gap changing device configured to change the prescribed gap.

5. A method for forming an image on a recording member, comprising:

forming a non fixed toner image on a recording member by applying heat to the non fixed toner image on the recording member;

providing a pair of pressure applying rollers for applying pressure at a conveyance direction of the recording member;

separating the pair of pressure applying rollers with a prescribed gap; and applying pressure and fixing the non-fixed toner image onto the recording member using the pair of pressure applying rollers, wherein said applying heat to the non fixed toner image includes:

generating a laser light;

defusing and scanning the laser light emitted from a laser light scanning device to the non fixed toner image electrostatically attracted onto a conveyance belt, wherein the laser light scanning device is used as an exposure device for forming a latent image on an image bearer, changing a beam spot diameter of a laser beam by a beam spot diameter-changing device, installing at least the image bearer onto the process cartridge, guiding the laser light to the image bearer via a light path guide, and wherein a light path through which the laser light for fixation passes thereto radiates light to the non fixed toner image on the recording medium.

6. The image forming apparatus as claimed in claim 1, wherein the second fixing device includes a heat radiating device configured to radiate heat.

7. The image forming apparatus as claimed in claim 6, wherein the heat radiating device contacts an upper roller of the second fixing device.

8. The image forming apparatus as claimed in claim 2, wherein said process cartridge including the beam spot diameter changing device is arranged on the light path and configured to change a diameter of the beam of the laser light.

9. The image forming apparatus as claimed in claim 2, further comprising a laser light emission device.

10. The image forming apparatus as claimed in claim 9, wherein the laser light emission device is a concave lens.

11. The image forming apparatus as claimed in claim 10, wherein a curvature shape of the concave lens and a distance to the conveyance belt are approximately determined in accordance with a spot of the emission laser light.

12. The image forming apparatus as claimed in claim 10, wherein the concave lens is included in the process cartridge.

13. The image forming apparatus as claimed in claim 2, wherein the process cartridge includes an image formation section, in which a photoconductive member, a charging device, a developing device, and a cleaning device.

14. The image forming apparatus as claimed in claim 10, wherein the light path serves as an installation section to install the concave lens serving as a diffusion lens for diffusing the laser light.

15. The image forming apparatus as claimed in claim 14, wherein the light path guide is provided at a light entrance side opening formed on the light path installation section.

* * * * *